US008396241B2

(12) United States Patent
Satake et al.

(10) Patent No.: US 8,396,241 B2
(45) Date of Patent: Mar. 12, 2013

(54) REFLECTOR STRUCTURE, SOUND FIELD ADJUSTING METHOD, COLUMNAR REFLECTOR STRUCTURE, ROOM, PROGRAM, AND VARIOUS ACOUSTIC ROOM DESIGNING SYSTEM

(75) Inventors: Yasushi Satake, Tokyo (JP); Hideo Tsuru, Tokyo (JP); Kazuhiro Makino, Tokyo (JP); Shinji Ohashi, Tokyo (JP); Hiroshi Ohyama, Tokyo (JP)

(73) Assignee: Nittobo Acoustic Engineering Co., Ltd., Tokyo (JP)

( * ) Notice: Subject to any disclaimer, the term of this patent is extended or adjusted under 35 U.S.C. 154(b) by 244 days.

(21) Appl. No.: 12/993,496

(22) PCT Filed: May 21, 2009

(86) PCT No.: PCT/JP2009/059359

§ 371 (c)(1),
(2), (4) Date: Nov. 19, 2010

(87) PCT Pub. No.: WO2009/142267

PCT Pub. Date: Nov. 26, 2009

(65) Prior Publication Data

US 2011/0064234 A1 Mar. 17, 2011

(30) Foreign Application Priority Data

May 21, 2008 (JP) ..... 2008-133368

(51) Int. Cl.
*H04R 1/20* (2006.01)

(52) U.S. Cl. ..... 381/337; 381/353; 381/354

(58) Field of Classification Search ..... 381/337, 381/353, 354; 181/155, 175
See application file for complete search history.

(56) References Cited

U.S. PATENT DOCUMENTS 5,969,301 A * 10/1999 Cullum et al. ..... 181/286

FOREIGN PATENT DOCUMENTS

| | | | |
|---|---|---|---|
| JP | 60-28798 U | | 2/1985 |
| JP | 60-92299 U | | 6/1985 |
| JP | 4-197288 A | | 7/1992 |
| JP | 7-248775 A | | 9/1995 |
| JP | 8-302850 A | | 11/1996 |
| JP | 2003-22078 A | | 1/2003 |
| JP | 2004339830 | * | 12/2004 |
| JP | 2007-291804 A | | 11/2007 |

* cited by examiner

*Primary Examiner* — Brian Ensey
(74) *Attorney, Agent, or Firm* — Birch, Stewart, Kolasch & Birch, LLP

(57) ABSTRACT

There is provided a sound field adjusting method that can provide an acoustic improvement effect tailored to the characteristics of various acoustic rooms, with small differences in reflection properties between sound receiving points. The diameters of a plurality of columnar reflectors are calculated so as to diffuse sound waves of respective different frequency ranges. An arrangement condition is calculated so that the columnar reflectors having the calculated diameters form a plurality of reflecting surfaces that reflect the sound waves of different frequency ranges in random reflection directions, with random reflection time delays, or in random phases. The plurality of columnar reflectors having respective different diameters are then arranged under the arrangement condition. The arrangement condition is calculated to form a reflecting surface for a sound wave of a higher frequency range near a sound source, and form a reflecting surface for a sound wave of a lower frequency range far from the sound source. A sound absorbing structure by using the internal space of the arranged columnar reflectors provides effective countermeasures against low-range standing waves.

21 Claims, 30 Drawing Sheets

X

Only wall surface (Comparative Example 1)

Comparative Example 1 (only wall) Mid-low range: 500Hz

Comparative Example 1 (only wall surface)
Instantaneous sound pressure distribution: 500Hz Comparative Example 1 (only wall) High range: 2000Hz Comparative Example 1 (only wall surface)
Instantaneous sound pressure distribution: 2000Hz Oblique reflector plates (comparative Example 2)

Comparative Example 2 (oblique reflector plates) Mid-low range: 500Hz

Comparative Example 2 (oblique reflector plates)
Instantaneous sound pressure distribution: 500Hz Comparative Example 2 (oblique reflector plates) High range: 2000Hz Comparative Example 2 (oblique reflector plates)
Instantaneous sound pressure distribution: 2000Hz Periodic circular columns (comparative Example 3)

Comparative Example 3 (periodic circular columns) Mid-low range: 500Hz

Comparative Example 3 (periodic circular columns)
Instantaneous sound pressure distribution: 500Hz Comparative Example 3 (periodic circular columns) High range: 2000Hz Comparative Example 3 (periodic circular columns)
Instantaneous sound pressure distribution: 2000Hz Random circular columns (Example 1)

Example 1 (random circular columns) Mid-low range: 500Hz

Example 1 (random circular columns)
Instantaneous sound pressure distribution: 500Hz Example 1 (random circular columns) High range: 2000Hz Example 1 (random circular columns)
Instantaneous sound pressure distribution: 2000Hz Comparative Example 4

Example 2

(a)

(b)

(a)

(b)

(a)

(b)

Measurements of acoustic material parameters (a)

(b)

(a)

(Sound-source side) (Sound-receiving side)

(b)

REFLECTOR STRUCTURE, SOUND FIELD ADJUSTING METHOD, COLUMNAR REFLECTOR STRUCTURE, ROOM, PROGRAM, AND VARIOUS ACOUSTIC ROOM DESIGNING SYSTEM

TECHNICAL FIELD

The present invention relates to a reflector structure, a sound field adjusting method, a columnar reflector structure, a room, a program, and a various acoustic room designing system, and more particularly to a reflector structure, a sound field adjusting method, a columnar reflector structure, a room, a program, and a various acoustic room designing system for a wide frequency range.

BACKGROUND OF THE INVENTION

Acoustic design and adjustment are essential for various acoustic rooms including studios, listening booths, and halls.

When performing room acoustic design and adjustment in such various acoustic rooms, appropriate sound absorption and diffusion processing is first needed so as to avoid acoustic problems such as multiple reflections (flutter echoes) occurring between opposed wall surfaces in the room and long-path echoes of large delay time.

For that purpose, the proportions of sound absorption, reflection, and diffusion on the wall surfaces (sound field, acoustic environment) are adjusted and members are selected in order to provide desired acoustic characteristics (such as reverberation time) depending on the purposes and utilizations of the various acoustic rooms.

However, when wall surfaces in a small space of various acoustic rooms are covered with sound absorbing members to avoid the acoustic problems, the sound field can often have absorption characteristics of poor frequency balance, in particular, with excessive sound absorption in a high range and insufficient absorption to the low range.

The reason is that popular porous materials typified by glass wool, rock wool, and the like, which are the sound absorbing materials in common use, have the acoustic characteristics to absorb sound waves more in higher ranges and less in lower ranges. In fact, the acoustic characteristics of the porous materials can cause feelings unfavorable for the acoustic characteristics of a studio, including a "sense of confinement" and a "muffled feeling" due to excessive sound absorption level in a high range, and "obscurity" due to insufficient absorption level in a low range.

on the other hand, if the balance between sound absorption and reflection in a small space is adjusted by configuring the wall surfaces with conventional combinations of "sound absorbing surfaces" and "reflecting surfaces," the reflecting surfaces or sound absorbing surfaces can exert an intense effect on certain locations and the sound field may be biased or vary greatly depending on the configuration and arrangement in a small space in particular.

Also, if the "sound absorbing surfaces" and "reflecting surfaces" are arranged regularly or periodically, particular reflection properties appear with periods corresponding to the arrangement pitch, causing "coloration" where certain frequencies are emphasized, or the like. Thus, it has been difficult to adjust for forming a sound field having well-balanced frequency characteristics.

As refer to Patent document 1, there is provided a sound absorbing layer which is arranged in front of a wall surface with respect to a sound source in a room and is made of a porous material for absorbing sound in the room. In addition, a diffusion layer of convex shape that diffuses sound passed through the absorption layer is arranged between the sound absorbing layer and the wall surface. The surface of the sound absorbing layer on the room side is formed in a convex diffusion shape for diffusing sound (hereinafter, referred to as conventional technology 1).

The sound absorbing structure of conventional technology 1 provides the effect of suppressing long-path echoes and flutter echoes of plane soundwaves in an architectural space by a considerable amount. A flutter echo refers to multiple reflections of soundwaves occurring in various acoustic rooms that are formed of reflective wall surfaces opposed in parallel. A long-path echo refers to reflected sound waves that are reflected by walls and the ceiling in a wide space and arrive with a time delay.

CITATION LIST

Patent Document

Patent document 1: JP-A-2007-291804

DISCLOSURE OF THE INVENTION

Subject to Solve the Problem

Since the sound absorbing structure of conventional technology 1 includes regular periodic arrays of sound absorbers and diffusers on the same respective planes, there has been the problem of coloration which produces large acoustic differences in position for one location to another location in the acoustic room.

Moreover, with the sound absorbing structure of conventional technology 1, the sound absorption characteristics of a high range are determined by the characteristics of the sound absorbing material in the front row. There has thus been the problem that it is difficult to provide desired absorption characteristics depending on the purposes of various acoustic rooms.

The present invention has been achieved in view of such circumstances, and it is an object of the present invention to solve the foregoing problems.

SUMMARY OF THE INVENTION

Means for Solving the Problem

A sound field adjusting method according to the present invention includes: calculating diameters of a plurality of columnar reflectors so as to diffuse sound waves of respective different frequency ranges; and calculating an arrangement condition so that the columnar reflectors having the calculated diameters form a plurality of reflecting surfaces that make reflection directions, reflection time delays of the sound waves of different frequency ranges, and/or phases of reflected sound random.

In the sound field adjusting method according to the present invention, the diameters and the arrangement condition are such that the reflecting surfaces form a reflecting surface for a sound wave of a higher frequency range near a sound source, and form a reflecting surface for a sound wave of a lower frequency range far from the sound source.

In the sound field adjusting method according to the present invention, the diameters and the arrangement condition are such that the columnar reflectors form a lower occupation density and/or a smaller area of projection near the/a sound source, and form a higher occupation density and/or a larger area of projection near the sound source.

In the sound field adjusting method according to the present invention, the diameters and the arrangement condition are such that the columnar reflectors form a reflecting surface that matches an acoustic impedance of a medium lying between the/a sound source and the columnar reflectors to an acoustic impedance inside the columnar reflectors.

In the sound field adjusting method according to the present invention, the diameters and the arrangement condition are calculated so that the columnar reflectors are arranged to diffuse reflected wavefronts of the sound waves.

In the sound field adjusting method according to the present invention, the diameters and the arrangement condition are such that a diffusion wall, reflecting wall, or sound absorbing wall is arranged behind the columnar reflectors.

In the sound field adjusting method according to the present invention, the diameters and the arrangement condition are such that the columnar reflectors are arranged in two or more rows corresponding to the respective frequency ranges.

In the sound field adjusting method according to the present invention, a sound absorbing layer is further arranged in or around a group of columnar reflectors formed of the plurality of columnar reflectors, and energy of diffusion/absorption, a frequency range, a reflection direction, and a reflection time structure of a sound wave incident on the group of columnar reflectors are controlled by a positional relationship between the sound absorbing layer and the group of columnar reflectors.

The sound field adjusting method according to the present invention further includes a sound absorbing mechanism that uses internal space of the columnar reflectors themselves.

In the sound field adjusting method according to the present invention, the columnar reflectors are generally circular columns, generally rectangular columns, generally elliptical columns, generally spherical in shape, or generally ball chain-like in shape.

In the sound field adjusting method according to the present invention, the columnar reflectors are made of wood, metal, resin, or plastic.

A columnar reflector structure according to the present invention is arranged with the diameters and the arrangement condition calculated by the sound field adjusting method.

A reflector structure according to the present invention is a reflector structure for diffusing, reflecting, or absorbing sound, including a plurality of reflectors arranged, the reflectors having a reflecting surface all or part of which is a curved surface.

In the reflector structure according to the present invention, the plurality of reflectors have different sizes.

In the reflector structure according to the present invention, the plurality of reflectors are arranged so as not to form parallel surfaces each other.

In the reflector structure according to the present invention, the plurality of reflectors are arranged so that a reflector lying farther from a sound source has a diameter or thickness greater than that of a reflector lying closer to the sound source.

In the reflector structure according to the present invention, the plurality of reflectors are arranged so that a reflector lying farther from the/a sound source has a higher occupation density and/or a larger area of projection than that/those of a reflector lying closer to the sound source.

In the reflector structure according to the present invention, a sound absorbing material is arranged between and/or around the plurality of reflectors.

In the reflector structure according to the present invention, an acoustic diffusing surface, reflecting surface, or absorbing surface is arranged farther from the/a sound source than the plurality of reflectors are.

A sound field adjusting method according to the present invention uses the reflector structure.

A room according to the present invention is a room in which the columnar reflector structure or the reflector structure is arranged.

A program according to the present invention makes a computer execute the sound field adjusting method.

A various acoustic room designing system according to the present invention includes the computer that executes the program.

Advantageous Effects of Invention

According to the present invention, it is possible to provide a sound field adjusting method that includes: calculating the diameters and the arrangement condition of a plurality of columnar reflectors so as to diffuse sound waves of respective different frequency ranges; and forming a plurality of reflecting surfaces that reflect the sound waves in random reflection directions/with random reflection time delays (phases), thereby supplying diffuse sound having desired frequency characteristics corresponding to the purposes of various acoustic rooms to a wide area within the sound field.

EXPLANATION OF LETTERS OR NUMERALS

100: PC

| | |
|---|---|
| 110: | input unit |
| 120: | memory unit |
| 130: | diameter calculation unit |
| 140: | arrangement condition calculation unit |
| 150: | control unit |
| 160: | output unit |
| 200: | 3D scanner |
| 300: | input device |
| 400: | display unit |
| 500: | printer |
| 600, 700: | wall surface |
| 610, 710: | sound wavefront |
| 620, 720: | diffuse wavefront |
| 630: | group of sound traps |
| 730: | group of columnar structural members |
| 731: | high-range columnar structural member |
| 732: | mid-range columnar structural member |
| 733: | low-range columnar structural member |
| 750: | sound absorbing layer |
| 800: | rigid wall |
| 810: | round bar |
| 811: | ϕ114-mm round bar |
| 812: | ϕ164-mm round bar |
| 813: | ϕ216-mm round bar |
| 814: | group of small round bars |
| 815: | group of thin round bars |
| 816: | group of thick round bars |
| 820, 821, 822: | sound absorbing material |
| X: | various acoustic room designing system |

DESCRIPTION OF EMBODIMENTS

First Embodiment

Control Configuration

Figure 1:
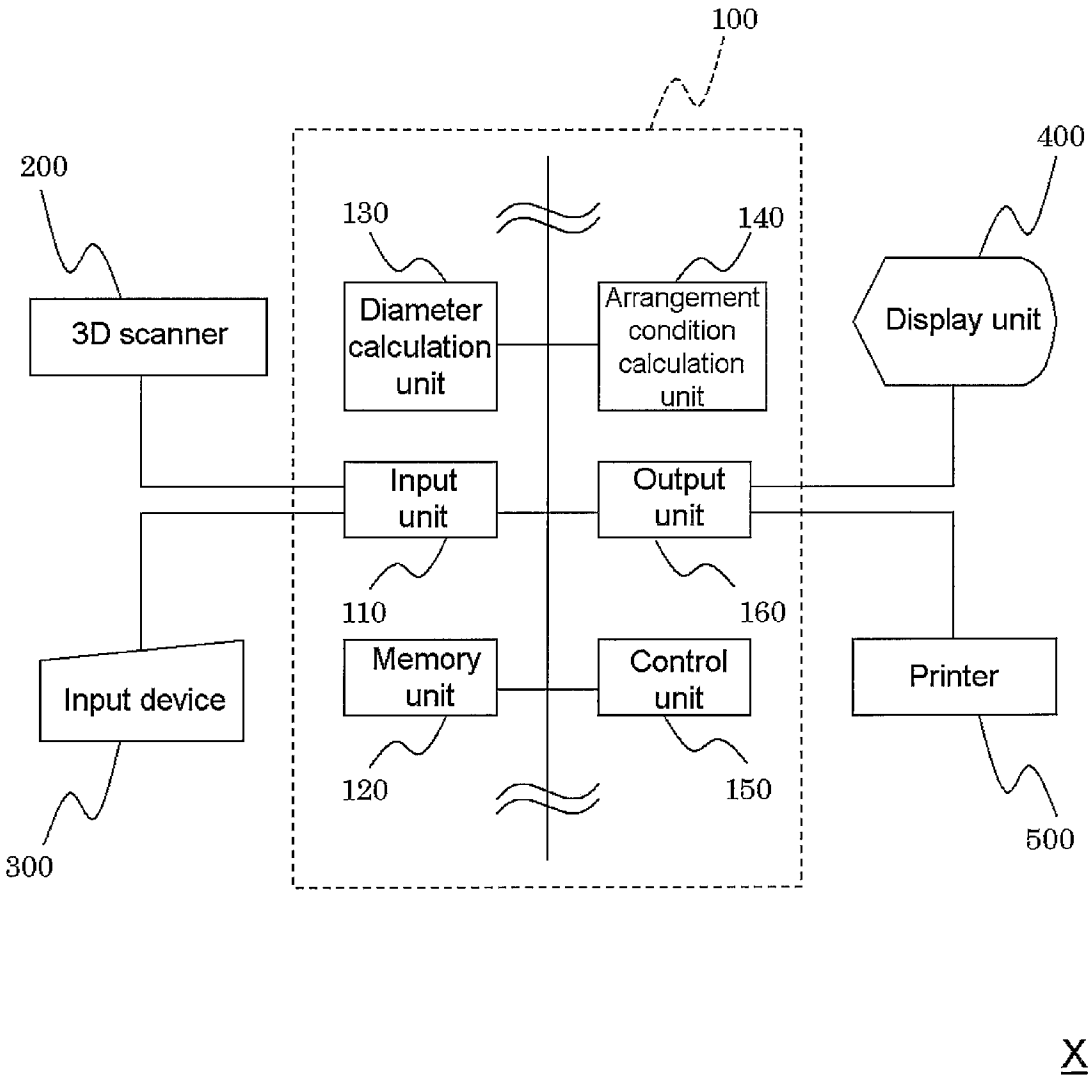
FIG. 1 is a control block diagram of a various acoustic room designing system X according to an embodiment of the present invention.

As refer to FIG. 1, the control configuration of a various acoustic room designing system X according to an embodiment of the present invention will be described.

The various acoustic room designing system X mainly includes a PC 100, a 3D scanner 200, an input device 300, a display unit 400, and a printer 500.

The PC 100 is a PC (Personal Computer) such as an ordinary PC/AT-compatible or a MAC-type PC. The PC 100 is the component that can carry out an operations of a sound field adjusting method according to the embodiment of the present invention. The PC 100 mainly includes: an input unit 110 (inputting means) which inputs various types of data; a memory unit 120 (memorizing means) which memorizes the input data, prediction model formulas, predicted results, and so on; a diameter calculation unit 130 (diameter calculating means) which is an arithmetic unit or the like for calculating the diameters of columnar reflectors to be described later; an arrangement condition calculation unit 140 (output value calculating means) which is an arithmetic unit or the like for calculating the arrangement condition of the columnar reflectors; a control unit 150 such as a CPU (Central Processing Unit) and an MPU (Micro Processing Unit); and an output unit 160 which outputs the results of calculation of the operations.

The 3D scanner 200 is a publicly known 3D (three-dimensional) scanner by using a laser or the like. By placing primarily in the centers of various acoustic rooms, the 3D scanner 200 can convert the three-dimensional room structures of the acoustic rooms, the exact distances to the wall surfaces, and the like into 3D data. Known examples of such a 3D scanner include the laser scanners from FARO Technologies, Inc., U.S. (see "http://www.faro.com/default.aspx?ct=jp" and others).

The input device 300 is a component pertaining to user interfaces, including a keyboard, pointing devices such as a mouse, and a touch panel.

The display unit 400 is a general LCD display, plasma display, organic EL (electroluminescence) display, or the other display devices. The display unit 400 may be configured to display the room structure in three dimensions by using a liquid crystal shutter method, hologram method, or the like.

The printer 500 is a printing device such as a general printer and an XY plotter. The printer 500 may include a flash memory card reader/writer or the like so that it can store design drawings, the diameters and arrangement of columnar reflector diameters, etc.

The PC 100 will be described in more detail.

The input unit 110 is an I/O or the like that performs input from an inputting means such as the 3D scanner, the input device 300, a LAN interface, a flash memory card reader, and a DVD-ROM. The input unit 110 can thereby input measurement data on various acoustic rooms from the 3D scanner 200, and such data as the design drawings of various acoustic rooms set in advance by the measurement operator.

The memory unit 120 is a RAM, ROM, flash memory, HDD (Hard Disk Drive), or the like. The memory unit 120 stores the data input from the 3D scanner 200, data on the design drawings and the like, a program of the sound field adjusting method according to the embodiment of the present invention, and data such as parameters needed for the program.

The diameter calculation unit 130 is an arithmetic unit that is capable of real-time operations, such as a dedicated arithmetic DSP (Digital Signal Processor), a physical operation-specific arithmetic unit, and a GPU (Graphics Processing Unit). The diameter calculation unit 130 calculates the diameters of columnar reflectors.

The arrangement condition calculation unit 140 is also an arithmetic unit that is capable of real-time operations, such as a dedicated arithmetic DSP, a physical operation-specific arithmetic unit, and a GPU. The arrangement condition calculation unit 140 calculates an optimum arrangement condition for the columnar reflectors.

The control unit 150 is a component that performs control and calculations when actually performing noise determination processing to be described later. The control unit 150 performs various types of control and calculation processing according to the program stored in the ROM, HDD, or the like of the memory unit 120.

The output unit 160 is an I/O or the like that performs output to an outputting means such as the display unit 400 and the printer 500. The output unit 160 can output the designed structures and design drawings of various acoustic rooms. The output unit 160 can also output the diameters of columnar reflectors and the design drawing, or arrangement condition, of the columnar reflector structure and the like. The output unit 160 includes an audio I/O, and can simulate and output what actual sound is like by a simulation to be described later.

The functions of the diameter calculation unit 130 and the arrangement condition calculation unit 140 may be implemented by using the arithmetic functions of the control unit 150.

[Sound Field Adjusting Method]

From here, the sound field adjusting method according to the embodiment of the present invention will be described in outline.

As mentioned previously, various acoustic rooms need to be formed in limited space, and there is only a limited margin of space for construction work. It is therefore needed to perform sound field adjustments based on acoustic designing and acoustic construction, and combine reflecting walls and absorbing walls to provide a space of favorable reverberations.

The room sound fields (acoustic environment) in artificially-formed various acoustic rooms, however, have problems such as the sense of confinement due to excessive sound absorption at high frequencies in particular, and an inarticulate feeling at low frequencies due to insufficient absorption at the low frequencies.

In order to solve such problems with the sound fields of various acoustic rooms, the inventors of the present invention made intensive studies and experiments.

The inventors of the present invention then found that a plurality of reflectors of column-like shape (columnar reflectors) having different diameters can be suitably combined to resolve unnatural reverberations in various acoustic rooms. It should be noted that the columnar reflectors of the present invention may be sound-diffusing, -reflecting, or -absorbing reflectors of arbitrary shapes as long as the effects of the present invention can be obtained.

In the sound field adjusting method according to the embodiment of the present invention, the diameters of the columnar reflectors are calculated from a relationship between frequency and wavelength or the like. The arrangement conditions in various acoustic rooms are also calculated.

Specifically, the diameters are initially calculated of columnar reflectors that effectively diffuse sound waves in target frequency ranges. As employed herein, "diffusion" refers that directions and/or reflection time delays (phases) for sound waves of different frequency ranges are reflected in random.

Then, an arrangement condition is calculated so that columnar reflectors of smaller diameters are located closer to (inside, on the near side) the sound source for high frequency diffusion, and columnar reflectors of greater diameters are located farther from (on the wall side, on the far side) the sound source so as to diffuse or absorb bass sound that is diffracted, not diffused, to circumvent.

Constructed by using the sound field adjusting method with the calculated diameters and arrangement condition, various acoustic rooms can provide a natural sound field inside over a wide frequency range from low to high frequencies.

Figure 2:
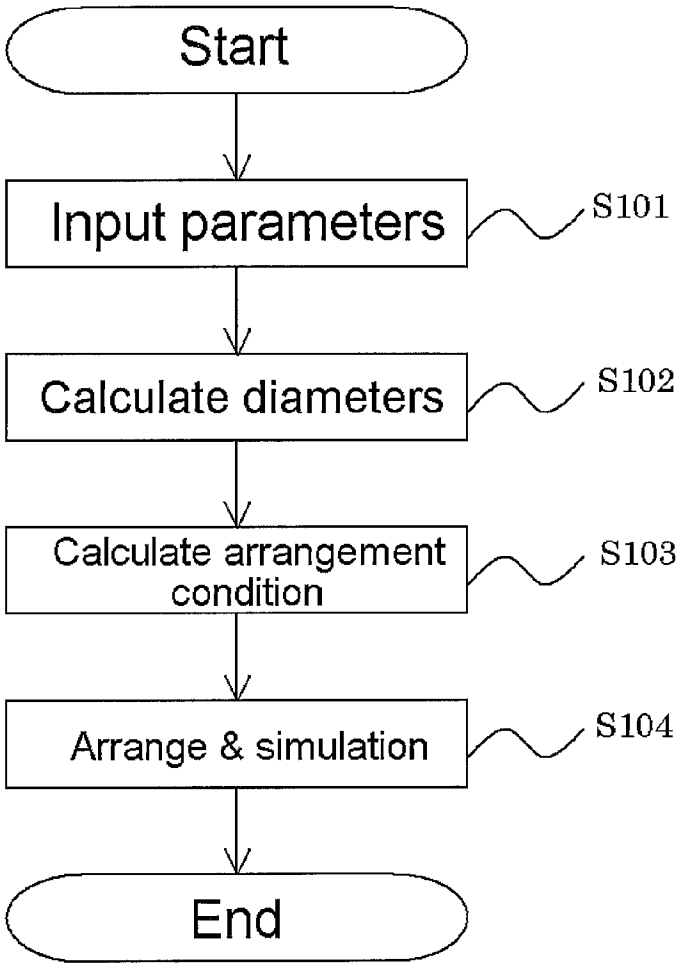
FIG. 2 is a flowchart pertaining to the operation of the various acoustic room designing system X according to the embodiment of the present invention.

Hereinafter, the actual operation of the various acoustic room designing system X will be described in more detail with reference to the flowchart of FIG. 2.

According to the operation procedure of the various acoustic room designing system X, the PC 100 is initially activated to start executing the program of the sound field adjusting method stored in the memory unit 120.

(Step S101)

The input unit 110 inputs data and parameters for performing a sound field adjustment according to the embodiment of the present invention from the 3D scanner 200 and the input device 300.

Examples of the data to be input include three-dimensional data on the shapes of various acoustic rooms. Examples of the parameters to be input include size and other parameters of various acoustic rooms, arrangement condition setting parameters, target frequencies, parameters for setting the diameters of the columnar reflectors, and intensity and other parameters of reflected waves.

When inputting three-dimensional data on the shapes of various acoustic rooms by using the 3D scanner 200 as the size and other parameters of the acoustic rooms, the scanner is placed in the center of the room to furnish actually, and laser light or the like is radiated to obtain three-dimensional coordinate values from the reflected time, etc.

For the three-dimensional data, a CAD file such as a DXF file may be input through a LAN interface, or from a recording medium such as a flash memory card and a DVD-R.

Instead of the three-dimensional data on the various acoustic rooms, the values of the length, width, and height of the acoustic rooms entered by the user from the input device 300 may be detected and input as the size and other parameters of the acoustic rooms. Size and other parameters may be similarly input even if the three-dimensional data includes no scale (size) settings.

Examples of the arrangement condition setting parameters include how many rows (stages) to configure the columnar structural members in, whether to configure the columnar structural members in any rows, whether there is any sound absorbing layer, and what centimeters from the wall surface are used for the columnar reflector structure. Such arrangement condition setting parameters may be set for each area that is specified by the coordinates of the three-dimensional data. For example, each surface being specified by coordinates, and the surface to the rear wall may be provided with first to third rows and the surfaces to the side walls with first to fourth rows. Since the columnar reflectors can be installed in any directions with respect to the direction of gravitational force, angles to the directions of the X-, Y-, and Z-axes may be specified. Installation methods may also be selected, including whether to use beams, whether to employ an open-end structure (single-sided installation), whether to connect the column ends to both the ceiling and the floor, and whether to employ a ceiling-hung structure. In addition, the degree of random arrangement may be set which shows the degree of how irregularly to settle the columnar reflectors to be described later are installed. Factors such as the visibility rate of the background in the plane of projection perpendicular to the longitudinal direction of the installed columnar structural members may also be set.

As for the target frequency, the frequencies at which the columnar reflectors to be described later are targeted may be set. For example, a target frequency may be set for each row of the columnar reflector structure. More specifically, with two rows, two types of frequencies "high (high range)" and "mid-low (mid range, low range)" of 1000 Hz and 500 Hz may be given as the parameters. Optimum values of the target frequencies may be calculated based on the three-dimensional data on various acoustic rooms, the size and other parameters of the acoustic rooms, the arrangement condition setting parameters, etc.

As for the parameters for setting the diameters of the columnar reflectors, parameters may be set as to whether to calculate the diameters based on the foregoing target frequencies, whether to calculate the target frequencies when respective predetermined diameters are selected, etc.

For acoustic characteristics of each frequency range, parameters may be set as to whether to make the diffusion effect in each frequency range uniform or to make the effect vary from one target frequency to another.

Aside from such parameters, the materials and types of the columnar reflectors may be set as parameters. The default (standard) setting of the material of the columnar reflectors, in view of the FireServiceAct, is inflammable wood. The reason is that inflammable wood has moderate internal loss and is acoustically excellent.

It is understood that metals and plastics (resins) may also be used for the material of the columnar reflectors. As the metals, alloys having high internal loss and alloys having vibration-cutoff capacity can be used. As a plastic, vinyl chloride, acrylic resins, etc., can be used.

As for hollow metal, sound absorbing substances may be filled into, or a sheet to suppress vibration may be put, etc. Such techniques are suitably used to suppress the resonance of the metal itself.

As for plastics, it is also preferred to select resonance resistant resin substances in order to manage for anti-vibration.

Sound absorbing mechanisms for using the internal space of the columnar reflectors may be used as countermeasures against standing waves in various acoustic rooms.

The shape of the columnar reflectors, or the sectional shape in particular, may be set as a parameter.

The standard setting of the sectional shape of the columnar reflectors is a circular column, which is preferable. Intensive studies made by the inventors of the present invention show that reflected waves can be dependent on the direction of incidence of sound waves if the reflecting surfaces are flat like those of rectangular columns. More specifically, by using flat-surfaced columns causes mirror reflection of sound waves that have wavelengths sufficiently smaller than the surfaces. This tends to make the reflection of sound waves directional, and variations in the sound field characteristics will occur.

In contrast, by using circular columns, sound waves having larger frequencies proportional to the diameters can be almost ideally reradiated. This makes it possible to put back uniformly diffused sound to a wider area.

Aside from the circular columns, the sectional shape of elliptical columns can also provide favorable acoustic characteristics. In other words, it is preferred that the acoustic diffusing surfaces, reflecting surfaces, and/or absorbing surfaces are curved surfaces. It is also preferred that sound-diffusing, -reflecting, and/or -absorbing reflectors of arbitrary shapes have a curved or spherical acoustic diffusing surface, reflecting surface, and/or absorbing surface.

The columnar reflectors to be selected need not necessarily be a perfect circular column in shape but may be knotty as like wood thinned from forests. The columnar reflectors may have a branch and leaf structure as like actual trees. The columnar reflectors may also have such shapes as a random combination of spherical members as like a ball chain, as well as ellipsoids and spheres themselves.

For the same reason, shapes such as "entasis" and other bulged columns, a bowling pin, and a Coca Cola® bottle may be used. Such shapes provide a higher effect of three-dimensional diffusion.

In view of construction problems and the like, polygonal columns such as rectangular and triangular columns may be selected despite the foregoing reasons. In such a case, special acoustic effects can be obtained unlike with circular or elliptical columns. For example, fractal forms having self-similarity can be used to provide polygons having excellent diffusion characteristics. The reflectors are preferably arranged so as not to form parallel surfaces each other.

Such complicated shapes can be input from the 3D scanner 200 or by using a CAD DXF file or the like.

The acoustic impedances at the surfaces of the columnar reflectors may be set as parameters. The reason is that ordinary lacquer finishing and urethane finishing have different wave reflectances.

For design-improving parameters, columnar reflectors of larger diameters arranged on the wall side (far side) may be finished in dark color and ones on the front side in light color to produce the feeling of depth.

The input parameters are stored by the input unit 110 into the memory unit 120.

(Step S102)

Then, the diameter calculation unit 130 calculates the diameters of the columnar reflectors according to the input parameters. If predetermined diameters are selected, the diameter calculation unit 130 calculates the target frequencies.

When sound waves impinge on a circular column, some of the sound waves are not simply reflected but reradiated (or diffused) in all directions as diffuse waves irrelevant to the direction of incidence.

The frequency range in which the reradiation (or diffusion) is likely is determined by the diameter of the circular column. The smaller the diameter, the higher the frequencies of the sound waves to be reradiated are. The greater the diameter, the lower the frequencies of the sound waves that can be reradiated are. The frequency range for such reradiation will be referred to as a "target frequency."

When sound waves of high frequencies impinge on a circular column of large diameter, the sound waves are diffused but with sharp directivity, not being uniformly reradiated. That is, the directions of radiation become nonuniform. The relationship between the diameter and the frequency range therefore has an optimum range.

In the meantime, sound waves having frequencies below the target frequency typically will not be reradiated but diffracted to reach behind. The inventors of the present invention found that such a property can be used to make an adjustment to the sound field.

In the sound field adjusting method according to the embodiment of the present invention, the diameters of the columnar reflectors need to be calculated so that incident sound waves diffuse throughout the acoustic room.

For that purpose, the diameters of the columnar reflectors are calculated based on the foregoing input parameters and the target frequencies corresponding to the arrangement condition to be described later.

The diameter calculation will be described in more detail.

The diameters of the columnar reflectors have heretofore been analyzed for situations where sound waves are incident on a cylinder, and it is possible to utilize such analyses (for example, see the Principles of Acoustic Engineering, "http://www.acoust.rise.waseda.ac.jp/publications/onkyou/genron-4.pdf").

When plane sound waves are incident on a cylinder having a radius of a, the energy flow (W) of scattered waves of the plane waves radiated from the cylinder, per unit length of the cylinder, is given by the following equation (1):

[Eq. 1]

$$\overline{W} = \frac{3}{4}\pi^2 k^3 a^4 \overline{w}_0(W) \tag{1}$$

$$\begin{cases} \overline{w}_0(W/\mathrm{m}^2)\text{: the density of the energy flow of the plane waves} \\ a(m)\text{: the radius}(m)\text{ of the circular column} \\ k = 2\pi/\lambda\text{: } k \text{ is wave number, lambda is wavelength}(m) \end{cases}$$

Meanwhile, the energy flow ($W_0$) of the plane waves incident on unit length of the cylinder is given by the following equation (2):

[Eq. 2]

$$\overline{W}_0 = 2a\overline{w}_0(W) \tag{2}$$

Thus, the rate (ratio) of scattering of the plane wave energy incident on unit length of the cylinder is given by the following equation (3):

[Eq. 3]

$$\frac{\overline{W}}{\overline{W}_0} = \frac{3}{8}\pi^2 k^3 a^3 \tag{3}$$

From the equations (1) to (3), if, for example, a circular column having a diameter of 0.4 m (a radius of 0.2 m) is given, the acoustic energy at frequencies higher than approximately 175 Hz, or the energy flow of the plane waves incident on unit length of the cylinder, is diffused by the cylinder by approximately 100%.

The following Table 1 shows the relationship between the lower limit frequency and the cylinder diameter where the rate of the energy of the incident waves diffused by the cylinder is approximately 1.

TABLE 1

| Diameter (m) | Frequency f | Wavelength λ (m) | k = 2Π/λ |
|---|---|---|---|
| 0.4 | 175 | 1.94 | 3.23 |
| 0.216 | 324 | 1.05 | 5.99 |
| 0.165 | 424 | 0.8 | 7.84 |
| 0.114 | 613 | 0.55 | 11.33 |
| 0.06 | 1165 | 0.29 | 21.53 |
| 0.045 | 1553 | 0.22 | 28.7 |
| 0.032 | 2183 | 0.16 | 40.34 |

Thus, to incident sound waves, acoustic energy above the frequencies corresponding to the cylinder diameters can be scattered, such as 2183 Hz and above for a diameter of 32 mm, 1553 Hz and above for a diameter of 45 mm, and 1165 Hz and above for a diameter of 60 mm.

In fact, the diffusion effect can be obtained with scattering rates of 1 and below.

According to the sound field adjusting method of the embodiment of the present invention, for example, a diameter of 30 to 75 mm is thus calculated if a high range target frequency of 1000 Hz or above is given.

Also, as given a mid-low range target frequency of approximately 630 Hz or above, the calculation of the diameter is 60 to 120 mm, for example.

Further, for a low-range target frequency of approximately 500 Hz and above, the calculation of the diameter is 80 to 160 mm, for example.

Thus, when, for example, columnar reflectors are arranged in two rows with a high range target frequency of 1000 Hz and a mid-low range target frequency of 500 Hz, the diameters of the columnar reflectors may be calculated to be 40 mm and 100 mm, respectively.

In addition, columnar reflectors of even greater diameter may further be used for a low range of 500 Hz and below. In such a case, the diameter can be calculated based on the optimum target frequency that is determined according to the size and properties (recording studio, hall, etc.) of the acoustic room. For example, if the acoustic room is a recording studio having a size of 7 m (width)×4 m (depth)×3 m (height), the diameter can be about 150 mm.

On the other hand, when using predetermined diameters, the frequencies of the reflecting surfaces of the sound waves can be calculated as the target frequencies.

For example, using the diameters of dimension lumber, calculations show that columnar reflectors having a diameter of 20 mm for a high range (a target frequency of approximately 2000 Hz), a diameter of 45 mm for a mid range (a target frequency of approximately 1000 Hz), and a diameter of 60 mm for a low range (a target frequency of approximately 630 Hz) may be arranged in three rows.

The diameters (or target frequencies) calculated in this step are used for the case of calculating the arrangement condition in the next step.

(Step S103)

Then, the arrangement condition calculation unit 140 calculates the arrangement condition of the columnar reflectors according to the input parameters and the foregoing diameters.

The sound field adjusting method according to the embodiment of the present invention is characterized in that (a) columnar reflectors of smaller diameters are arranged in front (on the inner side when seen from the sound source) and columnar reflectors of greater diameters behind, and (b) the columnar reflectors in each row are arranged at random intervals so as to avoid periodicity.

The arrangement (a) with columns of smaller diameters in front is employed because the reversal arrangement with thicker columnar reflectors in front is acoustically undesirable. The reason is that while the columnar reflectors of greater diameters diffuse sound waves of lower frequencies as described above, such columnar reflectors fail to diffuse the wavefronts of high frequency sound uniformly in all directions, resulting in high directivity.

According to the sound field adjusting method of the embodiment of the present invention, thin columnar reflectors for a high range are arranged in front as seen from the sound source, so as to diffuse sound waves of the high range.

This can produce gradual changes in the acoustic resistance (impedance) of the columnar reflectors, thereby preventing high-level reflection occurring at the surfaces of the diffusers.

The random arrangement (b) in each row is employed because it is possible to prevent coloration (a change in tone color) at a certain frequency due to regular arrangement. The coloration will be detailed in examples to be given later.

In order to finely diffuse the reflected sound, thinner columns are initially arranged in front at random intervals. The farther behind, the greater the column diameter. Thickest columns are arranged in the end row at random intervals.

The result is an acoustically-preferred, low-coloration sound field environment.

The arrangement condition will be described in more detail below.

[Calculation of the Number of Circular Columns, Intervals of Columns in a Row, and Intervals between Rows]

The actual number of columnar reflectors, the intervals in a row, the intervals between rows, and the like can be calculated with reference to the cross-sectional area of the columns per unit area (density) in the plane of projection of a section perpendicular to the longitudinal direction of the columns. In the plane of projection perpendicular to the longitudinal direction of the columns, the cross-sectional area (aperture ratio) of the columns per unit area of the plane of projection may be calculated with respect to each of the rows of the columnar reflectors. The number of columns and the intervals between rows may be set so that differences in the cross-sectional area fall within 10%.

In the plane of projection perpendicular to the longitudinal direction of the columns, the cross-sectional area (aperture ratio) of the columns per unit area of the plane of projection may be made almost constant for each of the rows of columnar reflectors of different diameters. Such an arrangement can provide the effect of reducing variations of the diffusion effect of the columnar reflectors depending on the frequency.

Conversely, when modifying the diffusion effect depending on the target frequency, the intervals between the columns can be changed from one row to another of the columnar reflectors of different diameters so that the cross-sectional area (aperture ratio) of the columns per unit area of projection varies from one row to another of different diameters.

When the columnar reflectors in a row are arranged at a periodic pitch, a particular reflection property occurs at periods corresponding to the arrangement pitches, facilitating "coloration" where sound of certain frequencies is emphasized. To prevent such an adverse effect, the columnar reflectors are arranged at random.

Examples of the method for implementing a random arrangement include the following procedure:

(1) Initially, for example, prepare three types of circular columns with different radii. Assume the large, medium, and small radii are a, b, and c, respectively.

(2) Then, arrange the circular columns of each size in a row at equal intervals. The interval u between the centers of the large circular columns is such that $2*a<u$. For the medium circular columns, the interval v is $2*b<v$. For the small circular columns, the interval w is $2*c<w$.

(3) The rows of large, medium, and small circular columns are arranged in parallel. The distance d between the lines that pass the centers of the large and medium circular columns in rows is such that $a+b<d$. The distance e between the lines that passes the centers of the medium and small circular columns in rows is $b+c<e$.

(4) Move the position of each circular column in the row direction or the row-to-row direction. Such movement can be achieved, for example, by: generating a uniform random number in the range of −0.5 and 0.5; subtracting the radii of circular columns from the center-to-center distance between circular columns (such as $u-2*a$ for large circular columns in the row direction; $d-(a+b)$ for a large circular column and a medium circular column in the row-to-row direction), and multiplying the resultant by the random number; and moving the circular column by the resulting distance.

The arrangement of the columnar reflectors in rows (stages) provides the effect of easy construction.

In addition, some of all the rows can be in random arrangement. For example, by adjusting for the construction space, only low-range reflectors with a target frequency of 500 Hz or below may be arranged at random.

The columnar reflectors may be arranged in a curved row, not straight, for each frequency range. For example, in the case of a movie theater where right, left, and center speakers are installed in front with a group of surround speakers behind, the intervals between the row structures may be made to increase toward the rear, thereby creating a surrounding sound field. Such adjustments in interval can be utilized to adjust the arrival times of reverberant sound in respective frequency ranges, thereby orchestrating a wider space.

By using such an arrangement condition, it is possible to create a sound field tailored to the characteristics of various acoustic rooms.

When the columnar reflectors of respective diameters are arranged in a plurality of rows or stages, the distances between the columns are adjusted according to the parameter on the visibility rate of the background in the plane of projection perpendicular to the longitudinal direction of the columnar reflectors.

By default (standard setting), it is preferred, for example, that the area of projection of all the columnar reflectors in the direction perpendicular to the longitudinal direction of the columns is 95% or more the entire area of projection if it is intended to improve the diffusion effect of the columnar structural members. That is, the arrangement is adjusted so that the group of columns makes the background almost invisible. It is also preferred that the columnar reflectors have a lower occupation density and/or a smaller area of projection near the sound source, and a higher occupation density and/or a larger area of projection far from the sound source.

Such an arrangement can alleviate the effect of sound waves not diffused by the columnar reflectors but reflected back from the rear wall surface. Even when there is no wall surface behind, the direct invisibility of the background makes it possible to substitute the columnar reflectors for a partition that will not affect the sound field.

The arrangement condition of a sound absorbing layer is also calculated based on the foregoing parameters.

With the columnar reflectors arranged under the foregoing arrangement condition, most of mid- and high-range sound is reflected by the front and center rows of columns, and it is mainly the low-range sound that reaches behind the rear row.

Depending on the sound absorbing patterns of various acoustic rooms, a film of sound absorbing layer or the like may be used to control the relationship between the frequency characteristic and the diffusion/absorption, the frequency ranges, the reflection directions, the reflection time structure, and the like by means of the positional relationship (relationship in position) between the columnar reflectors and the sound absorbing layer. In other words, it is possible to control the proportions of sound diffusion and absorption at certain frequencies.

Figure 3:
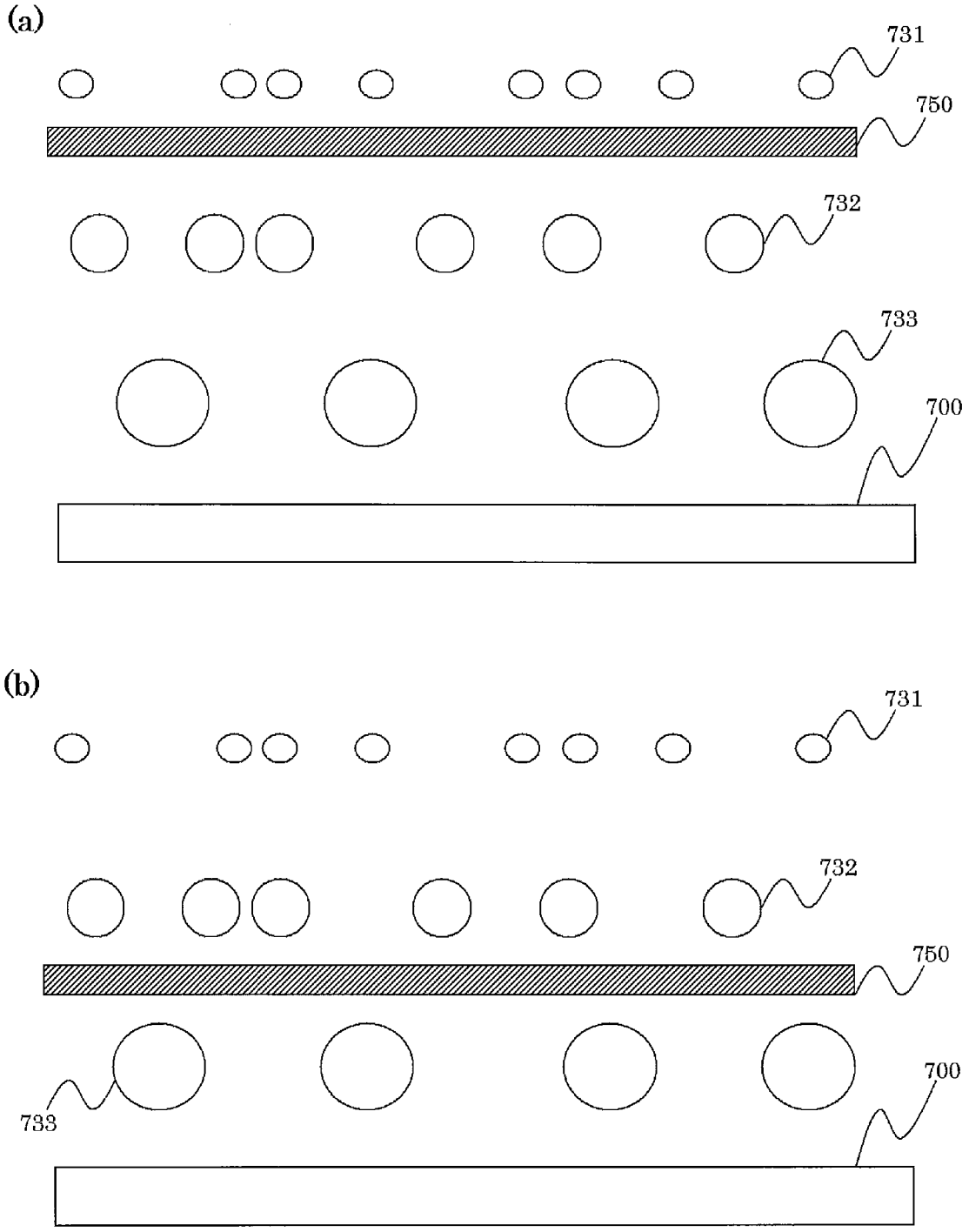
FIGS. 3*a* and 3*b* are a conceptual diagram showing examples where a sound absorbing layer is arranged between rows of columnar reflectors according to the embodiment of the present invention.

Detailed description will be given with reference to FIG. 3. FIG. 3 shows examples where a sound absorbing layer 750 (sound absorber) is arranged when a row of high-range columnar structural members 731, a row of mid-range columnar structural members 732, and a row of low-range columnar structural members 733 are arranged from the near side to the far side in front of a wall surface 700. The sound absorbing layer 750 may be made of glass wool, rock wool, urethane foam, felt, an acoustically transparent membrane, etc.

FIG. 3(*a*) shows an example of arrangement where the sound absorbing layer 750 is interposed between the row of high-range columnar structural members 731 and the row of mid-range columnar structural members 732. Such an arrangement can diffuse the high range and increase the amount of absorption in the mid-low range.

FIG. 3(*b*) shows an example of arrangement where the sound absorbing layer 750 is interposed between the row of mid-range columnar structural members 732 and the row of low-range columnar structural members 733. Such an arrangement can diffuse the mid and high ranges, and increase the amount of absorption in the low range and the amount of absorption of the sound reflected from the wall.

The sound absorbing layer can thus be installed based on the positional relationship with the columnar structural members, thereby adjusting the diffusion and absorption of sound waves with respect to each frequency range. This makes it possible to control the sound absorbing power in the mid and high ranges. In particular, the relationship between diffusion and sound absorption in the low to high ranges can be controlled according to the positional relationship where to arrange the sound absorbing layer, between the front and center rows or between the center and rear rows. It is therefore possible to control the sound absorbing intensity of the low range without making the sound absorbing power of the mid and high ranges excessively high.

In addition, if the sound absorbing layer 750 is arranged in front of the high-range columnar structural members 731, it is possible to absorb all the reflected sound of the low to high ranges and that from the wall surface 700.

When the sound absorbing layer 750 is made of a nontransparent material, it is possible to hide the columnar structural members behind. When the sound absorbing layer 750 is arranged behind the low-range columnar structural members 733, it is possible to control the power for absorbing the reflected low-range sound.

Furthermore, the sound absorbing layer 750 may also be arbitrarily arranged in a group of columnar reflectors, thereby adjusting the absorption characteristic or the reflection characteristic arbitrarily.

The sound absorbing layer need not be formed as a membrane, but may be columnar sound absorbers made of material such as felt and glass wool with improved sound absorbing intensity. The installation of such absorbers can make the sound absorption easier than with a film-shaped sound absorbing layer.

The diameters and the arrangement condition may be such as to form a reflecting surface that matches the acoustic impedance of the medium lying between the sound source and the columnar reflectors to the acoustic impedance in the columns. Typically, the medium is air.

In general, smooth energy transfer needs various contrivances.

For example, acoustic horns are a kind of acoustic impedance conversion devices, some of which transfer the vibrations of air around the acoustic vibration source to outside the horn with high efficiency through impedance matching. Similarly, there has been a sound absorbing wedge or the like intended for sound absorption, which forms a wedge shape so as to cause impedance conversion from the acoustic impedance of the transfer medium (air) into that of the porous member that constitutes the sound absorbing wedge. The sound absorbing wedge thereby converts the vibrational energy of the air into frictional heat energy in the porous material with high efficiency.

In the meantime, impedance matching is needed in order to efficiently introduce the air vibrations coming from inside the propagation medium into the inner areas of and the rear side of the columnar reflectors which form overlapping layers of reflecting surfaces.

According to the sound field adjusting method of the embodiment of the present invention, round bars of small diameter are arranged on the surface side, and the round bars are gradually increased in diameter toward the rear side of the columnar reflectors. This makes it possible to match the impedance at the surface to the impedance in the columnar reflectors.

The impedance matching may also be achieved irrespective of the diameters of the round bars, by increasing the aperture ratio on the surface side of the columnar reflectors and decreasing the aperture ratio toward the rear side of the columnar reflectors.

The impedance matching may also be achieved by increasing the occupied sectional area and/or the volume density of the round bars from the surface side to the rear side of the columnar reflectors in succession.

Consequently, the sound field adjusting method according to the embodiment of the present invention can perform impedance matching to introduce the air vibrations coming from inside the propagation medium with high efficiency.

Calculations as to the details of the impedance matching may be performed by using a difference-method program or the like.

As has been described above, the arrangement condition can be set to finely diffuse reflected sound over a wide range including low to high ranges, and remove harmful unnatural reverberations even in a space of limited depth. Frequency characteristics can also be adjusted.

Furthermore, the space inside the reflectors may be utilized to provide sound absorbing intensity for certain frequencies by means of a Helmholtz absorption structure, micro-pore plate absorption structure, etc. This allows efficient countermeasures against low-range standing waves in various acoustic rooms in particular.

(Step S104)

Finally, various acoustic room arrangement and simulation processing is performed according to the data on the acoustic rooms, including the calculations of the diameters and arrangement condition of the columnar reflectors.

The simulation processing may include such processing as measuring the time waveforms of reflected sound at the coordinates of arbitrary measurement points and outputting the waveforms in a graph form. The energy attenuation of the reflected sound may also be output in a graph form.

To create the graphs, the time responses of the direct waves from the sound source and all the reflected waves resulting from the reflection of all the plurality of columnar reflectors and the reflection of the wall surface, observed at set sound receiving points, are analyzed to calculate the transitions of the time waveforms, energy attenuation (level attenuation), and the sound pressure distribution.

Such graphs can be output by the output unit 160 to the display unit 400 or the printer 500.

A design drawing on the diameters and arrangement of acoustic diffusers can be output similarly.

Here, it is possible to output a design drawing of the columnar reflector structure, for example, such that a wooden base plate is hollowed to the calculated diameters and arrangement condition and columnar reflectors are inserted into the hollows.

A design drawing may also be created such that the columnar reflector structure is formed in a module configuration so as to be attached to the wall surfaces of various acoustic rooms.

An arbitrary sound may be specified by a WAV (waveform) file or the like, or input through a microphone, line, or other inputs, so that it is possible to listen to and check the actual acoustics in various acoustic rooms. In such a case, the user specifies the coordinates of the occurring point of the sound and the coordinates of the evaluation point from a GUI (Graphical User Interface) displayed on the display unit 400. The control unit 150 then detects the depression of a "Play" button displayed on the display unit 400 by the user, and performs waveform reproduction. Such calculations may be performed in real time by using a GPU or the like, thereby allowing the use as a reverberation device with actual physical calculations.

By default (standard setting), the sound source is an omnidirectional point source. Directions may be specified when simulating a speaker or the like. The hearing direction and the like at the evaluation point may be specified. Adjusting the arranged positions of the columnar reflectors, modifying the wall surface thickness and the shape of the acoustic rooms, and other operations may be performed.

The material, shape, finishing thickness, and the like of each columnar reflector may also be selected.

Based on the output graphs and reproduced sound, the user adjusts the parameters to recalculate the diameters and arrangement condition for arrangement and simulation.

In consequence, according to the sound field adjusting method by using the columnar reflectors, it is possible to design various acoustic rooms that have a wide coverage and well-balanced frequency characteristics.

It is then possible to form various acoustic rooms equipped with actual columnar reflector structures by performing the construction work by using the output design drawings.

EXAMPLES

Comparison Based on Simulation of Arrangement of Columnar Reflectors

Hereinafter, description will be given of the result of simulation of the sound field adjusting method according to the embodiment of the present invention, where the diffusion effect of the columnar reflectors was numerically simulated by a difference method. The simulation included calculations of a two-dimensional difference method, by using "comfida" software from Nittobo Acoustic Engineering Co., Ltd.

The space for diffraction calculation, or the shape of the acoustic room, was 7 min width and 4 m in depth. The calculations were made by a compact difference method. The grid interval was 10 m and the time step was 8 ns. Reflectors such as the wall, "Sound Traps™" to be described later, and the columnar reflectors were arranged on a single surface along a major side.

The sound source (the source of sound waves) was a typical Gaussian wave packet. With reference to the coordinates at the bottom left of the target space, the sound source was located at the coordinates (3.5, 3.0). Which means the position 3.5 m from the left end and 3.0 m in depth.

The sound source produced sound waves having a center frequency of 2000 Hz (2 kHz) for a high range and 500 Hz for amid-low range.

Then, the time waveforms of the reflected sound and the level (energy) attenuation waveforms of the reflected sound at two evaluation points (sound receiving points) were determined and plotted on respective graphs. The two evaluation points included an evaluation point A at the coordinates (1.5, 2.0) and an evaluation point B at the coordinates (3.5, 2.0). That is, the evaluation point A was at the coordinates of 1.5 m from the left end and 2 m in depth. The evaluation point B was at the coordinates of 3.5 m from the left end from the left end and 2 m in depth.

As for evaluating the characteristic of diffusion, a plurality of evaluation points were set that the purpose is to check the difference depend on the locations being low.

Simulation results will now be described for the cases: with a wall surface alone (Comparative Example 1); where acoustic diffusers using oblique reflector plates called "sound traps," commonly used in studios, were simulated (Comparative Example 2); where columnar reflectors were periodically arranged in three rows (Comparative Example 3); and where the same columnar reflectors were arranged in three rows at random (Example 1).

More specifically, Comparative Example 1 was where measurement was made only with a wall surface. Comparative Example 2 was a measurement example of conventional acoustic diffusers. Comparative Example 3 was where the arrangement condition of Example 1 was modified to be periodic. Example 1 was the case of forming a plurality of reflecting surfaces for reflecting sound waves of different frequency ranges at random, as calculated by the sound field adjusting method according to the embodiment of the present invention.

Hereinafter, the simulation results will be described in more detail in order of Comparative Example 1, Comparative Example 2, Comparative Example 3, and Example 1.

Comparative Example 1

Initially, Comparative Example 1 will be described with reference to FIGS. 4 to 8. As mentioned above, Comparative Example 1 simulates the state with only a mirror reflection at the intact wall surface with no columnar reflectors. The wall surface is formed to be slightly absorptive.

Figure 4:
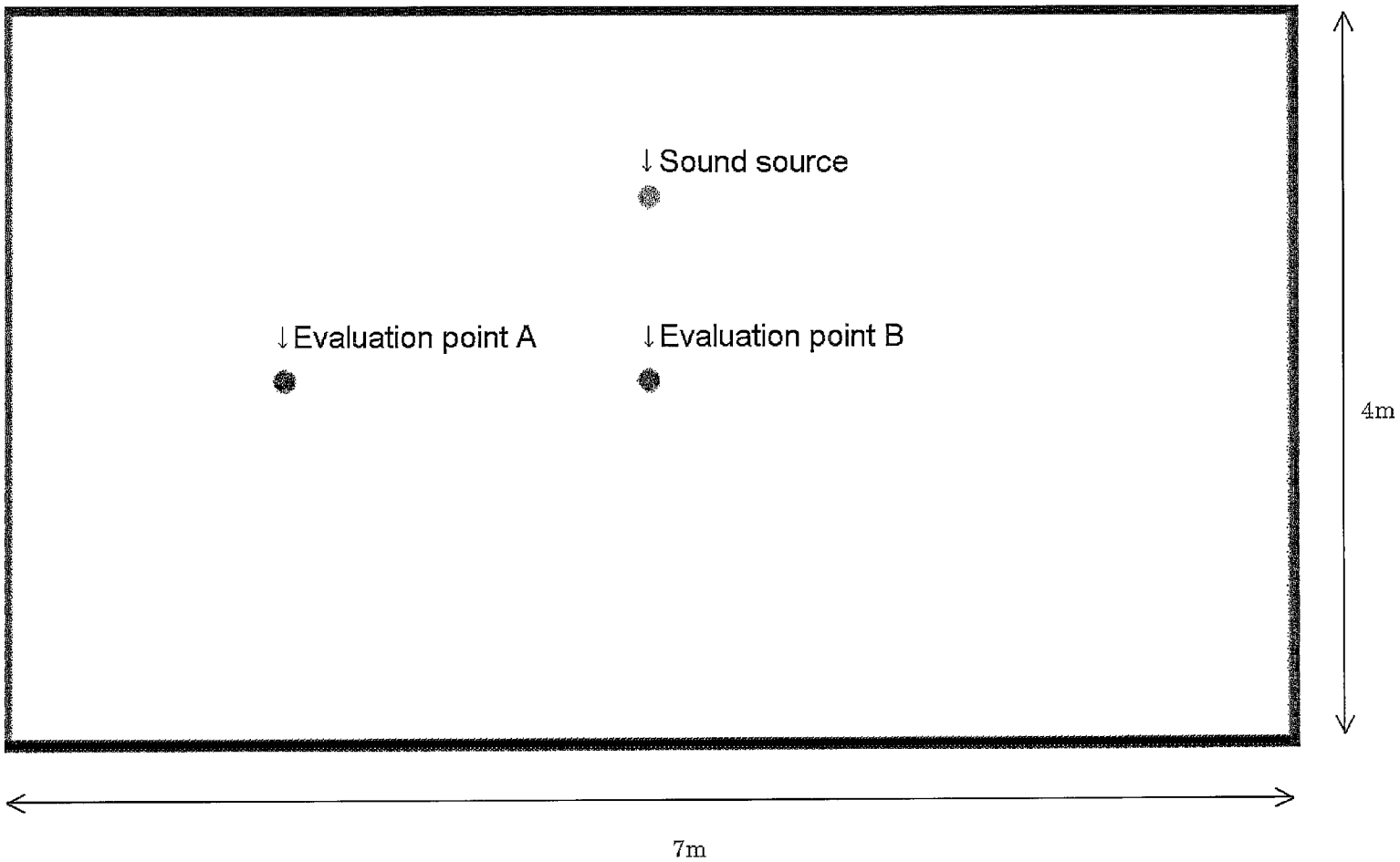
FIG. 4 is a conceptual diagram of the shape of an acoustic room in which simulation according to Comparative Example 1 of the embodiment of the present invention is performed.

FIG. 4 is a conceptual diagram showing the positional relationship between the acoustic room, the sound source, the evaluation point A, and the evaluation point B in a plan view.

Figure 5:
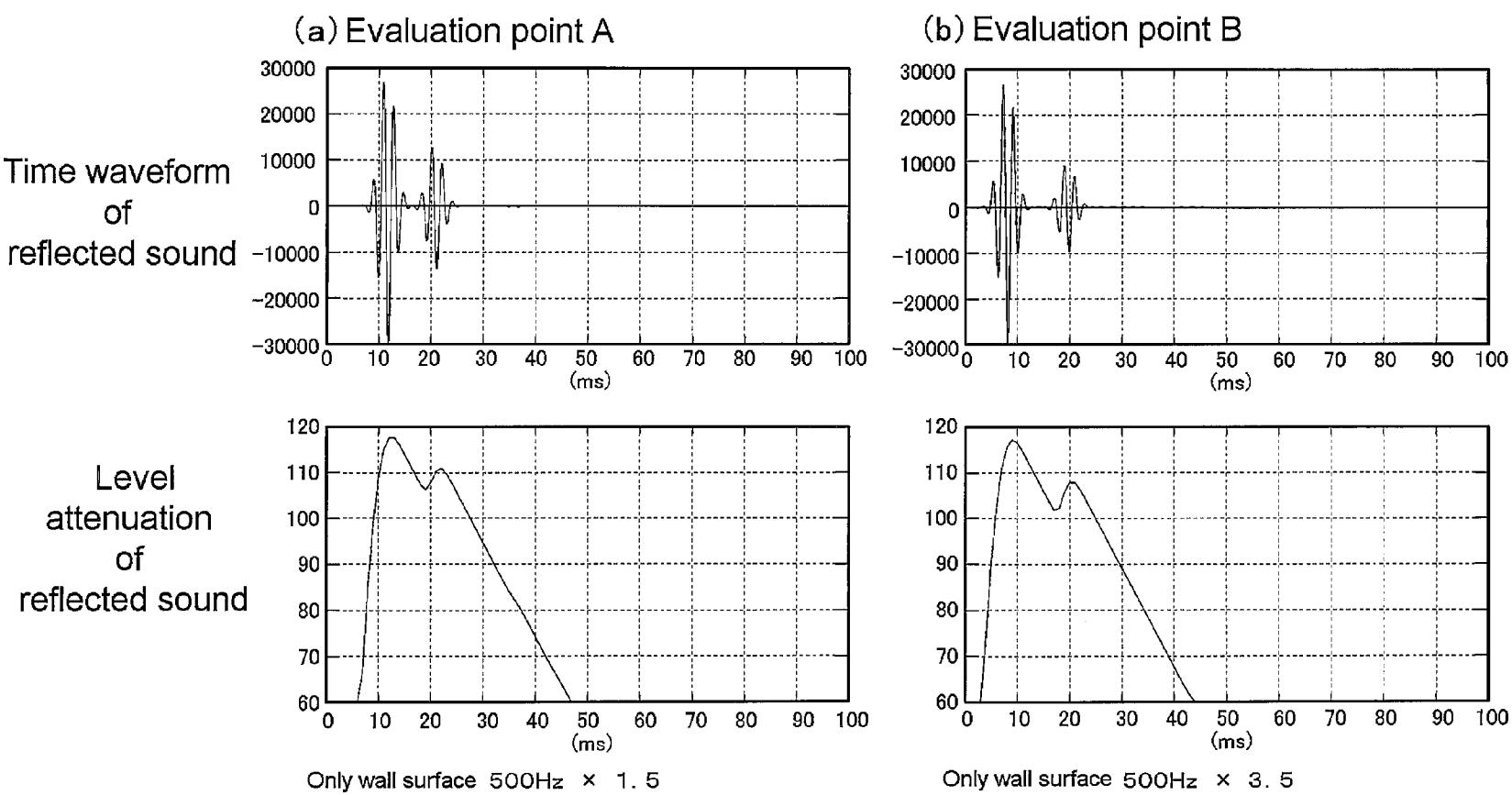
FIGS. 5*a* and 5*b* are graphs of the energy waveforms and time attenuation of reflected sound in a mid-low range according to Comparative Example 1 of the embodiment of the present invention.

FIG. 5 shows graphs of the time waveforms of reflected sound and the energy attenuation (level attenuation) of the reflected sound in the mid-low range of 500 Hz. FIG. 5(*a*) shows the graphs at the evaluation point A. FIG. 5(*b*) shows the graphs at the evaluation point B.

In the case with only a wall surface, the reflected sound is not diffused because of mirror reflection, and reflected waves of high amplitudes appear in certain times. In a closed space like various acoustic rooms, such reflected sound can cause flutter echoes and long-path echoes.

Figure 6:
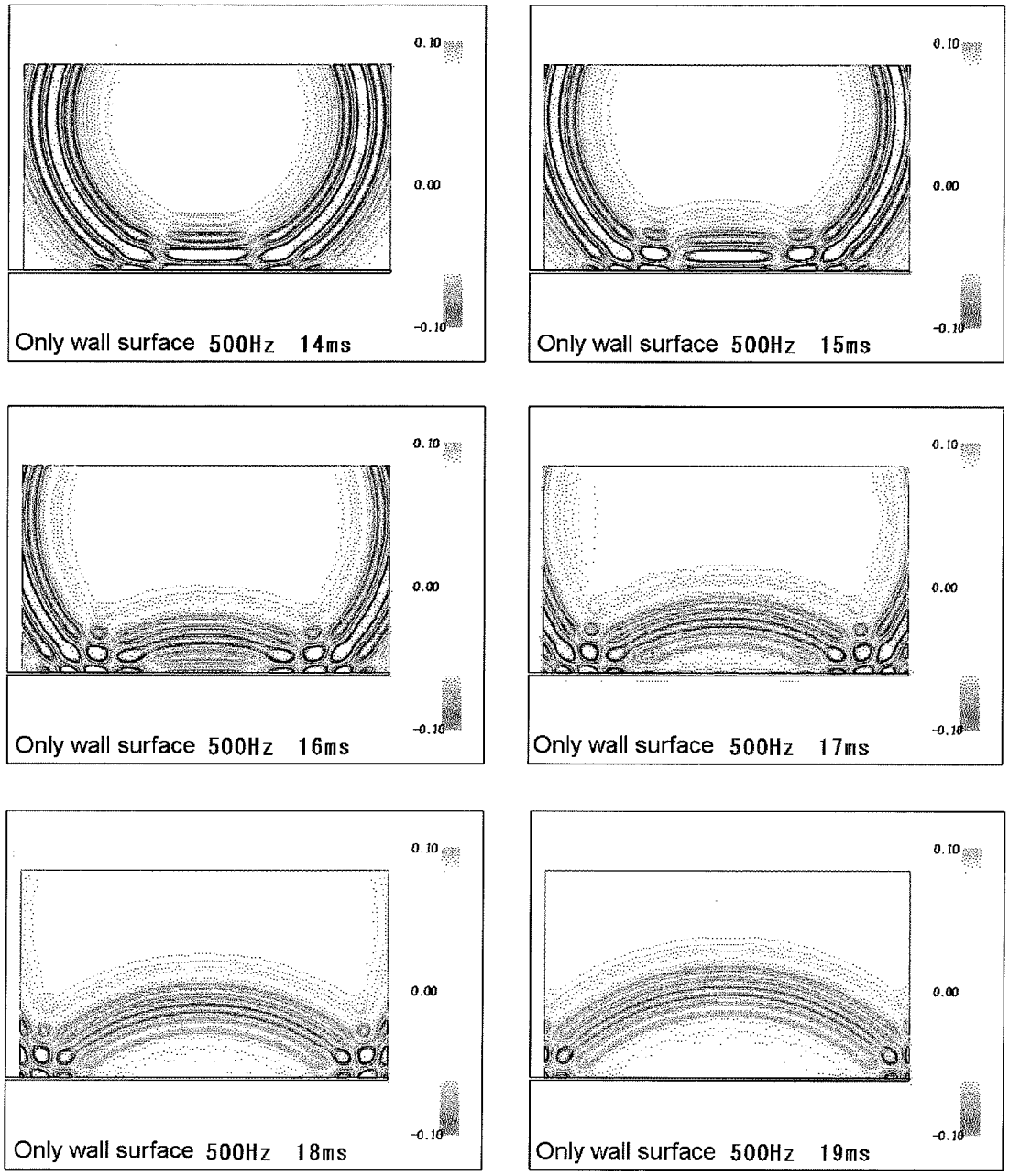
FIG. 6 is a diagram showing the result of a simulation of an instantaneous sound pressure distribution in the mid-low range according to Comparative Example 1 of the embodiment of the present invention.

FIG. 6 is a simulation result showing instantaneous sound pressure distributions at 500 Hz. It can actually be seen how mirror reflection occurs.

Figure 7:
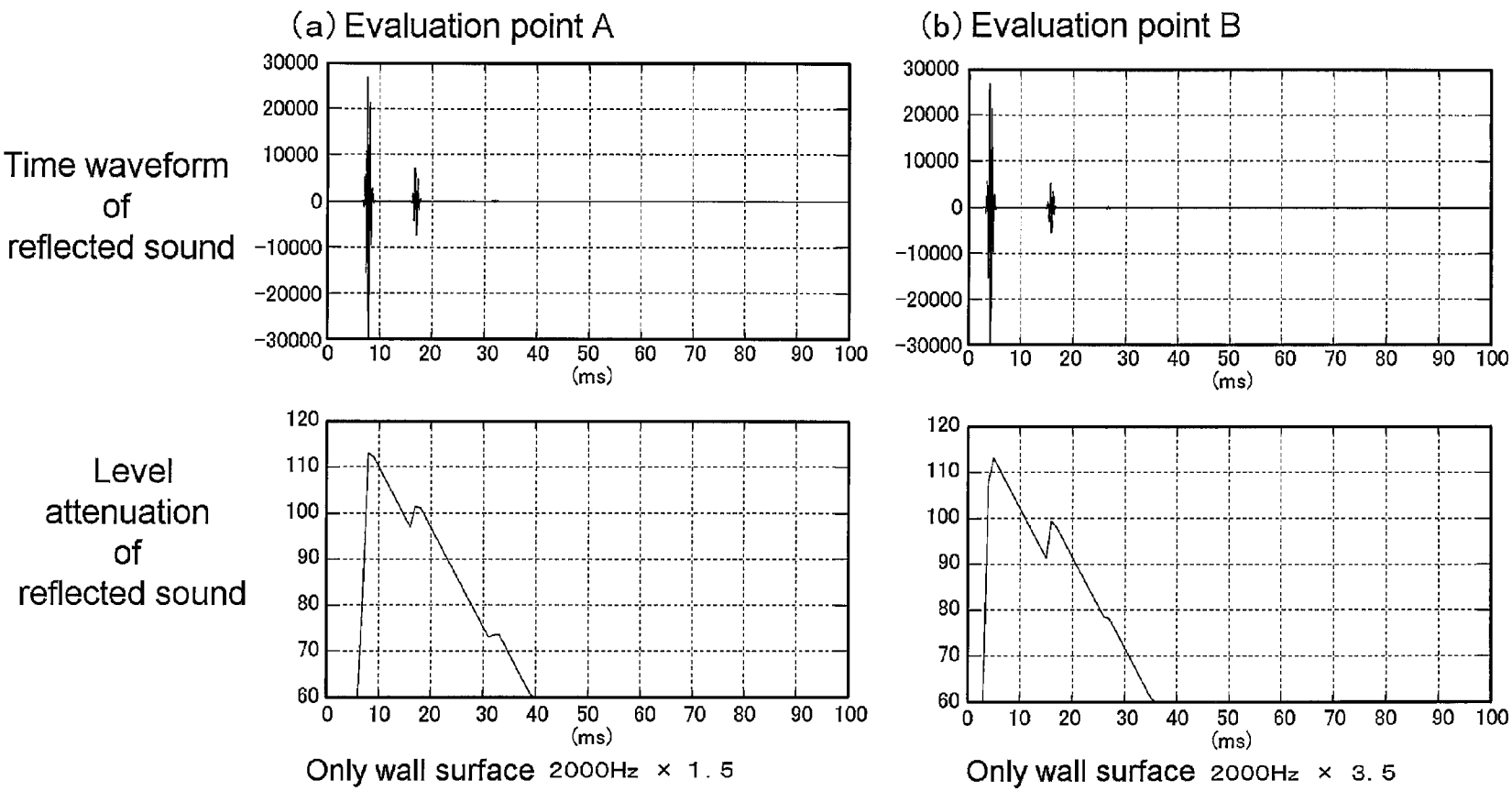
FIGS. 7*a* and 7*b* are graphs of the energy waveforms and time attenuation of reflected sound in a high range according to Comparative Example 1 of the embodiment of the present invention.

FIG. 7 shows graphs of the time waveforms of reflected sound and the energy attenuation (level attenuation) of the reflected sound in the high range of 2000 Hz. As in the mid-low range of FIG. 5, reflected waves of high amplitudes appear in certain times. FIG. 7(*a*) shows the graphs at the evaluation point A. FIG. 7(*b*) shows the graphs at the evaluation point B.

As can be seen, when direct sound and reflected waves of high amplitudes occur, the interference between the sounds adversely affects the sound field. Such an effect appears more significantly in the high range than in the mid-low range.

Figure 8:
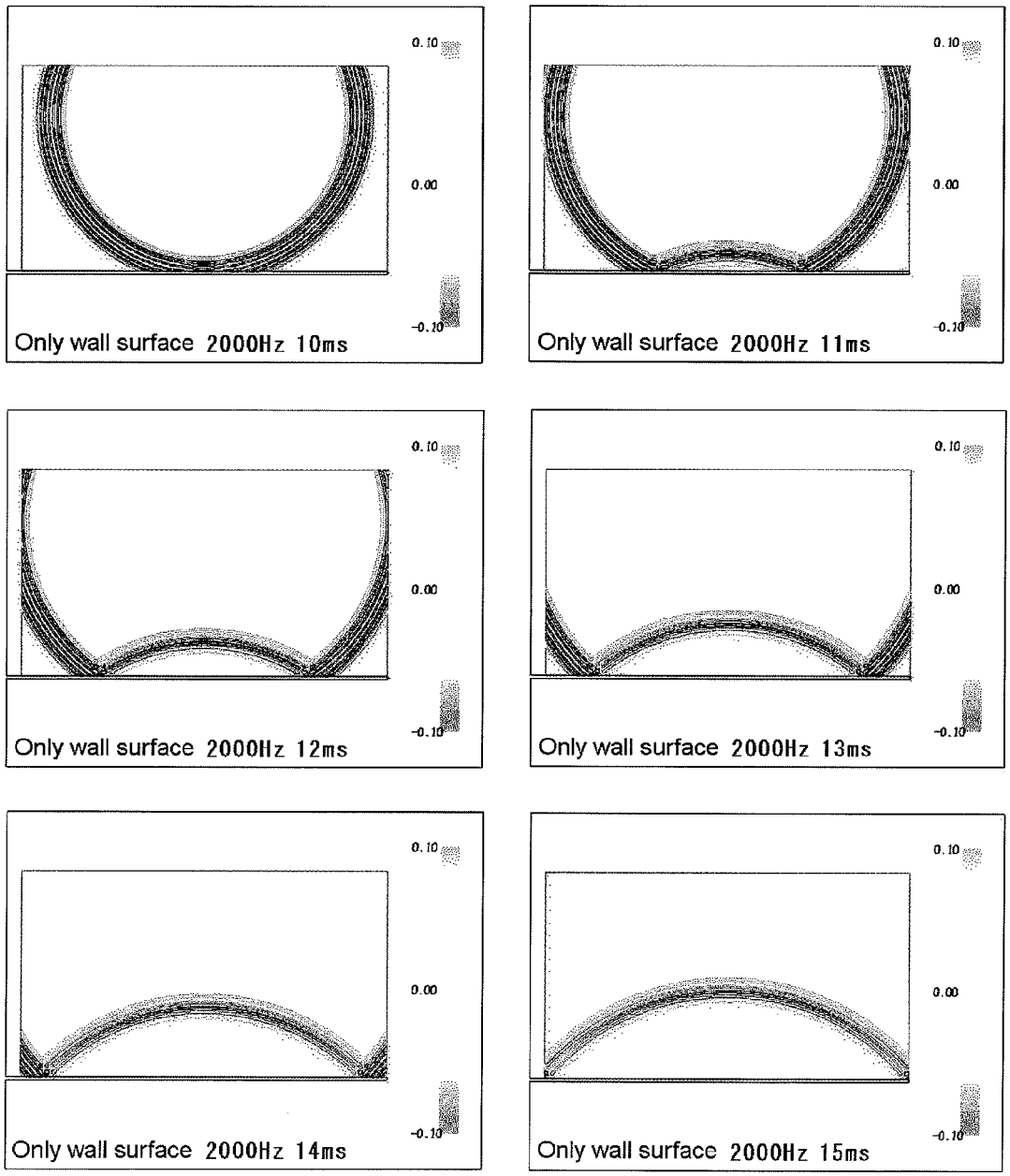
FIG. 8 is a diagram showing the result of a simulation of an instantaneous sound pressure distribution in the high range according to Comparative Example 1 of the embodiment of the present invention.

FIG. 8 is a simulation result showing instantaneous sound pressure distributions at 2000 Hz. As with 500 Hz, it can be seen that a single reflected sound of high level occurs from the wall surface.

Comparative Example 2

Then, Comparative Example 2 will be described with reference to FIGS. 9 to 13. In Comparative Example 2, a simulation was performed by using acoustic diffusers called "sound traps." The sound traps are acoustic diffusers made of plywood surfaced with glass wool, which are suspended from above for installation. The sound traps are commonly used in studios and the like.

Here, oblique reflector plates with 450 mm width and 300 mm inter-space pitch, which are typical sound traps and are obliquely arranged at 45° about the wall surface, were simulated.

Figure 9:
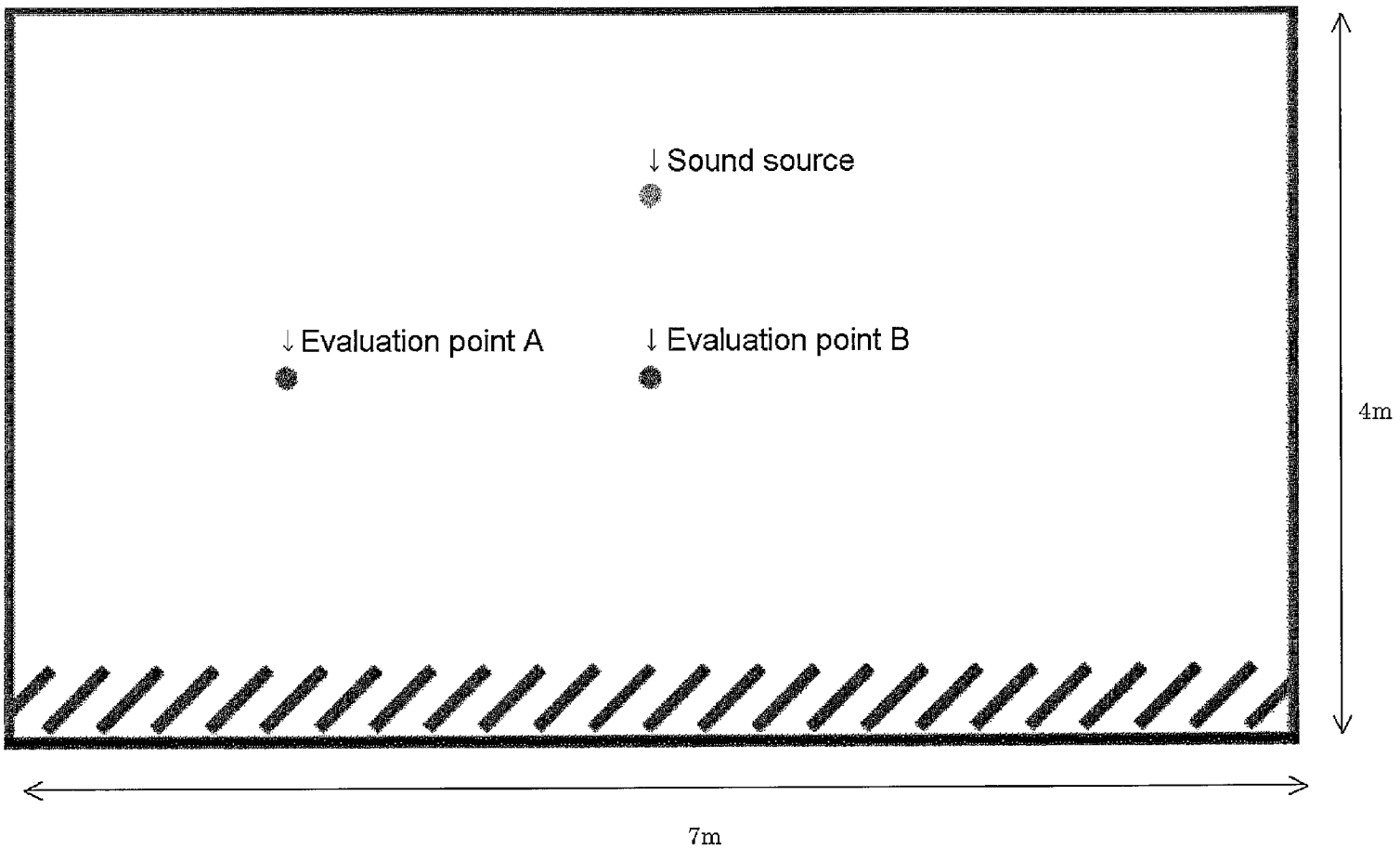
FIG. 9 is a conceptual diagram of the shape of an acoustic room in which simulation according to Comparative Example 2 of the embodiment of the present invention is performed.

FIG. 9 is a conceptual diagram of the acoustic room, showing in a plan view an example where the oblique reflector plates, which are sound traps, were arranged over a wall surface.

Figure 10:
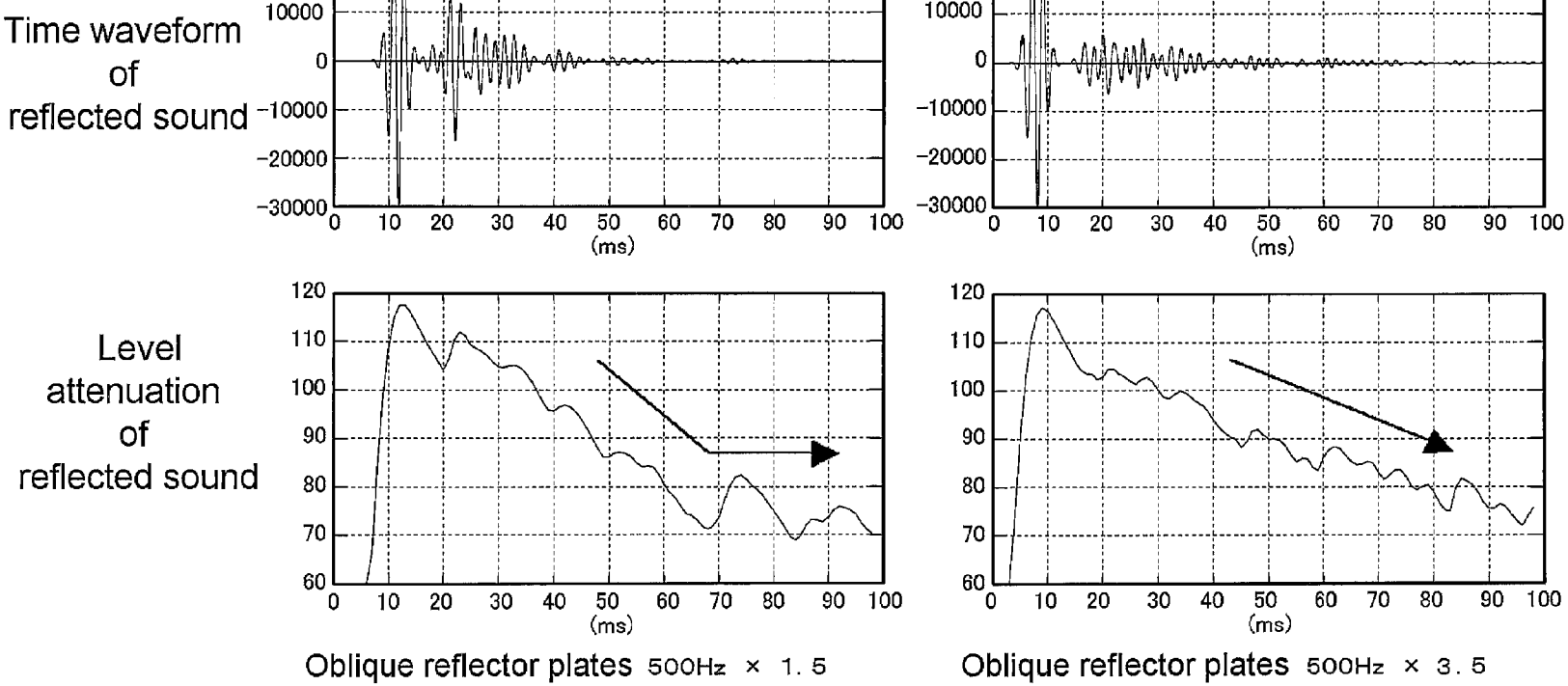
FIGS. 10*a* and 10*b* are graphs of the energy waveforms and time attenuation of reflected sound in a mid-low range according to Comparative Example 2 of the embodiment of the present invention.

FIG. 10 shows graphs of the time waveforms of reflected sound and the energy attenuation (level attenuation) of the reflected sound in the mid-low range of 500 Hz. FIG. 10(*a*) shows the graphs at the evaluation point A. FIG. 10(*b*) shows the graphs at the evaluation point B. The arrows in the graphs of level attenuation conceptually show the degrees of energy attenuation (the gradients of level attenuation).

In such an example with the conventional sound traps, the time waveforms of diffuse sound and the effect of the energy of the diffuse sound appear on the graphs aside from those of the reflected sound. It can be seen that the diffusion effect is higher than in Comparative Example 1.

However, it is shown that the reflected sound and the level attenuation vary greatly between the evaluation points A and B. In particular, the gradient pattern of the level attenuation differs significantly.

Figure 11:
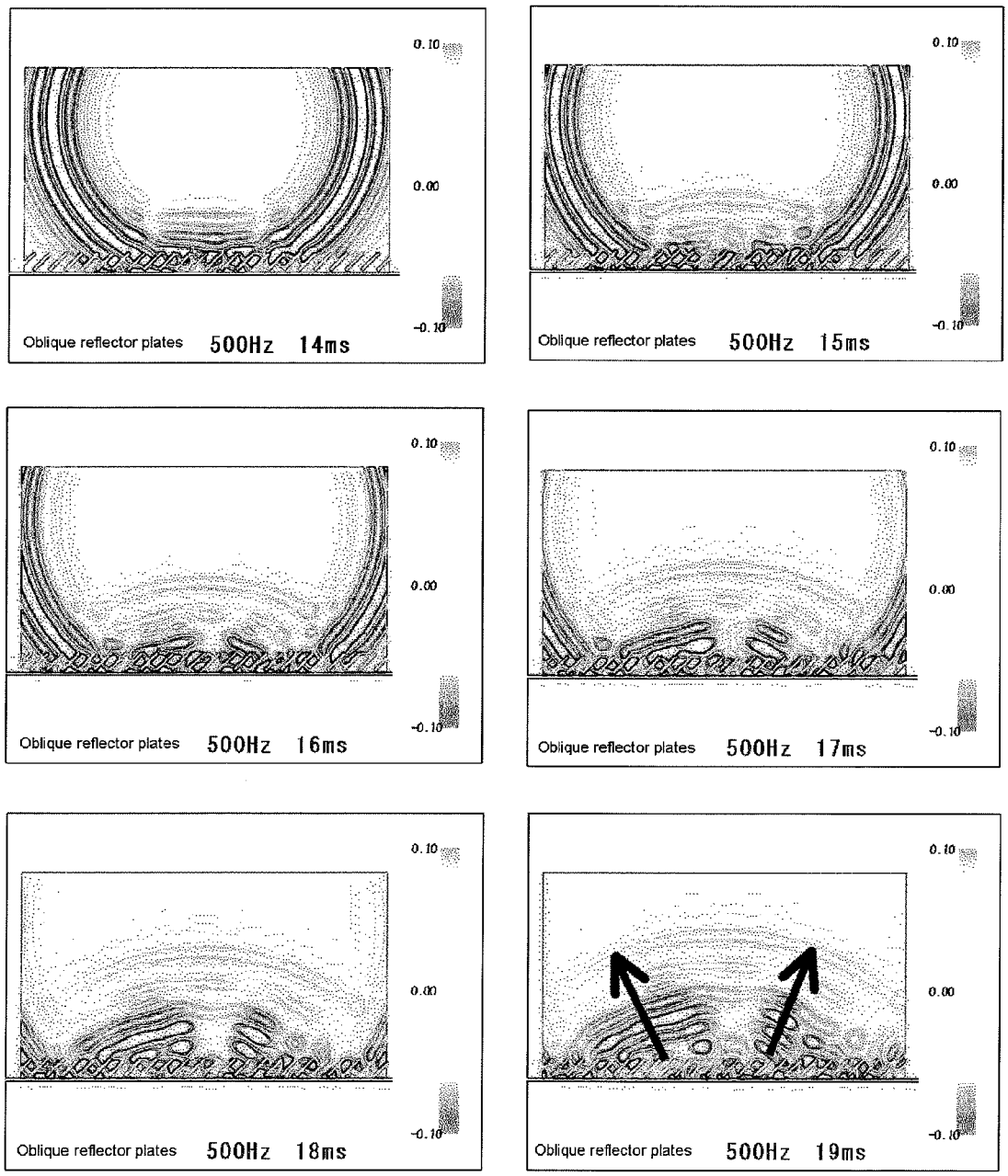
FIG. 11 is a diagram showing the result of a simulation of an instantaneous sound pressure distribution in the mid-low range according to Comparative Example 2 of the embodiment of the present invention.

FIG. 11 is a simulation result showing instantaneous sound pressure distributions at 500 Hz. From the diagram, it can be seen that the waves reflected by the oblique reflector plates form blocks. As shown by the arrows in the chart of 19 ms in FIG. 11, the blocks of reflected waves are observed mainly in two directions. This shows the occurrence of high reflection in certain directions.

More specifically, despite the diffusion more than in the foregoing case with only a wall surface, the arrival of the sound waves reflected in certain directions produces significantly different sound fields depending on the sound receiving points.

Such a large difference of the sound field depending on the listening position leads to the narrowness of a so-called "sweet spot."

Figure 12:
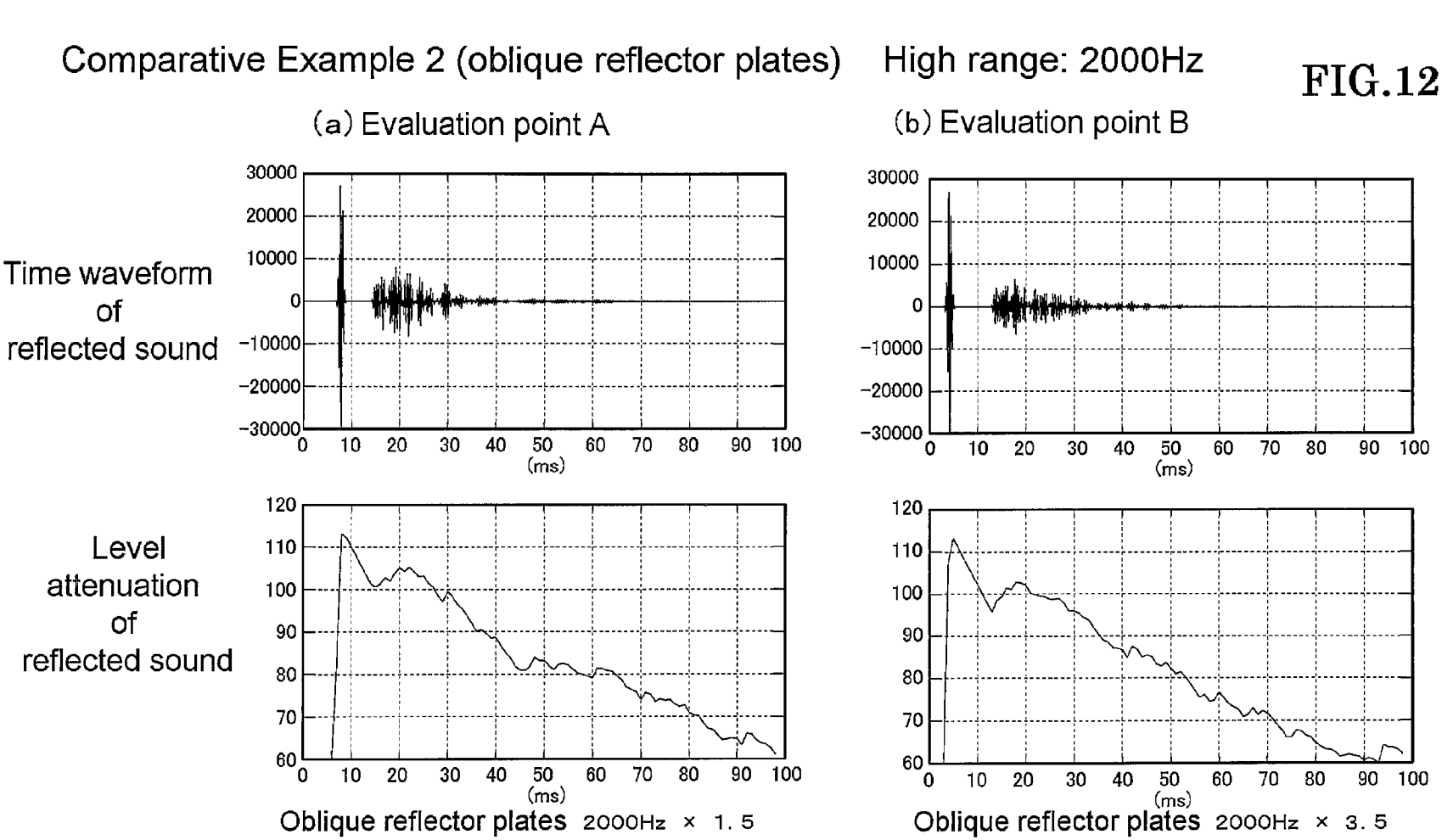
FIGS. 12*a* and 12*b* are graphs of the energy waveforms and time attenuation of reflected sound in a high range according to Comparative Example 2 of the embodiment of the present invention.

FIG. 12 shows graphs of the time waveforms of reflected sound and the energy attenuation (level attenuation) of the reflected sound in the high range of 2000 Hz. FIG. 12(*a*) shows the graphs at the evaluation point A. FIG. 12(*b*) shows the graphs at the evaluation point B. As seen in the graphs, the time waveforms and the level attenuation apparently have smaller differences than in the low range.

Figure 13:
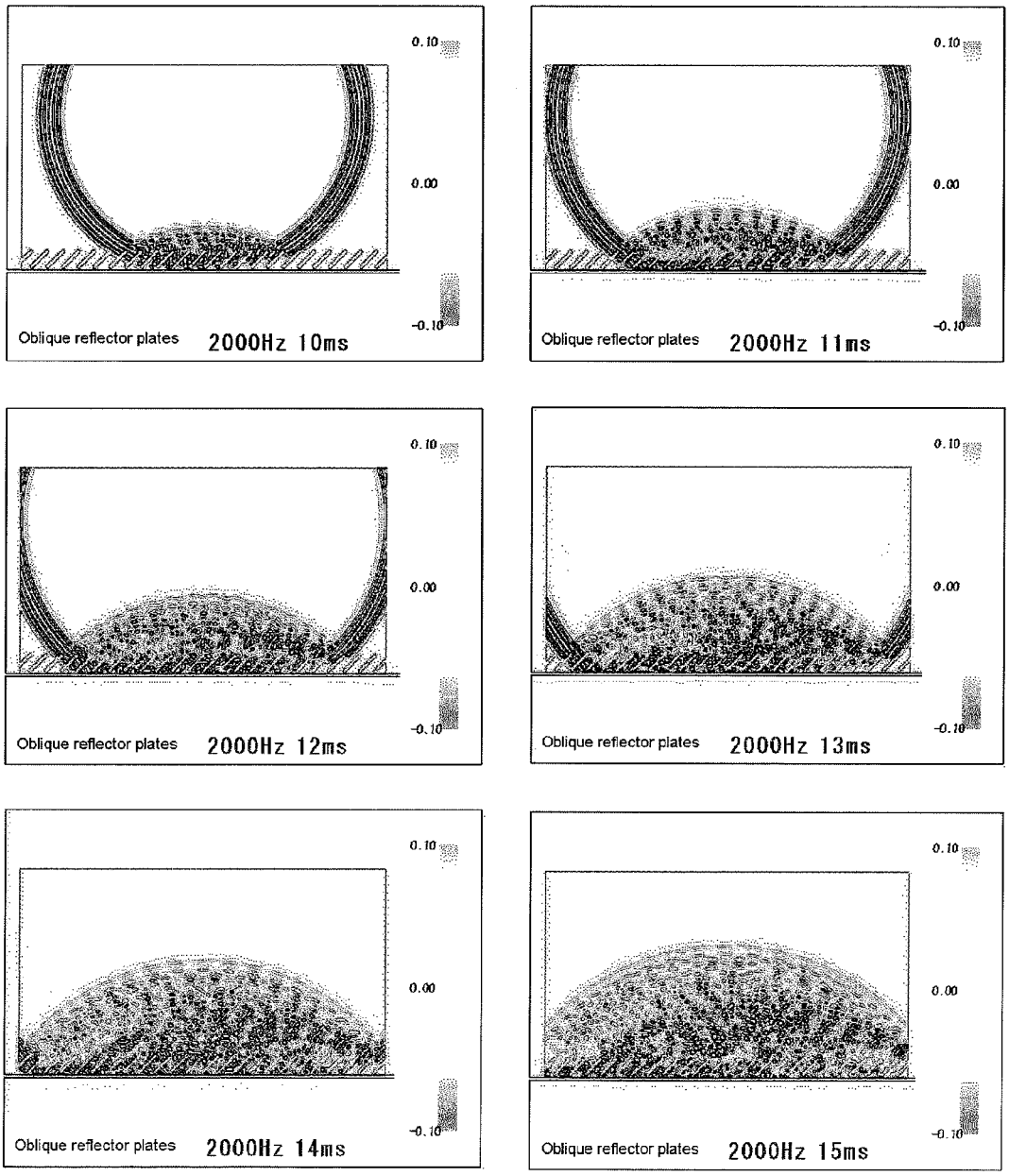
FIG. 13 is a diagram showing the result of a simulation of an instantaneous sound pressure distribution in the high range according to Comparative Example 2 of the embodiment of the present invention.

FIG. 13 is a simulation result showing instantaneous sound pressure distributions at 2000 Hz. Although it is difficult to see in the graphs described above, there is high reflection in certain directions, for example, in the areas surrounded by the wavy-lined ellipses in FIG. 13. It can be seen that the reflected sound will not much attenuate with the progress of time. Such reflected sound that does not vary with the progress of time can cause coloration at certain frequencies.

Comparative Example 3

Then, Comparative Example 3 will be described with reference to FIGS. 14 to 18. As mentioned above, Comparative Example 1 simulates the case where columnar reflectors are arranged in a periodic manner.

Figure 14:
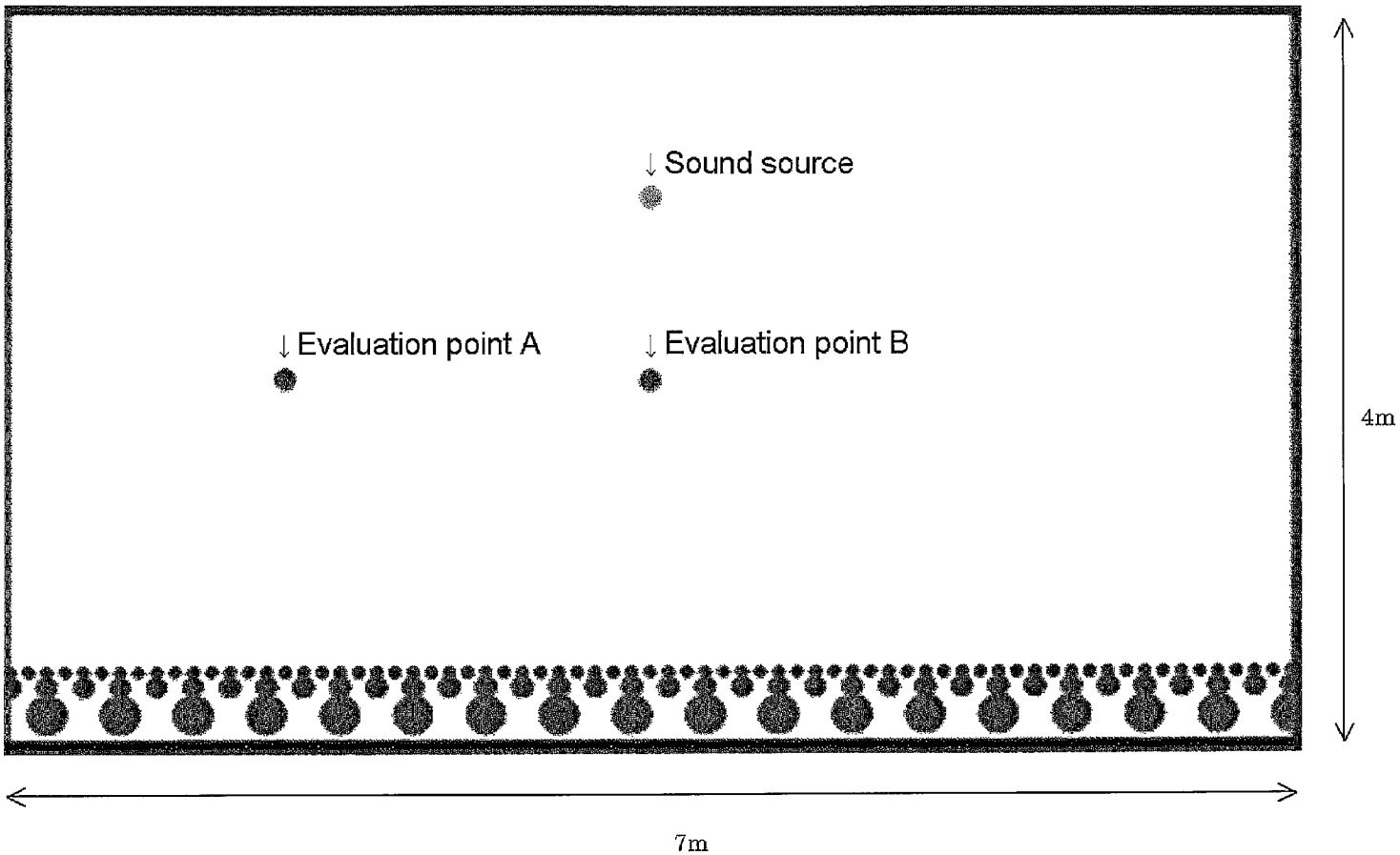
FIG. 14 is a conceptual diagram of the shape of an acoustic room in which simulation according to Comparative Example 3 of the embodiment of the present invention is performed.

In such an acoustic room, the diameters of the columnar reflectors in the respective rows and the intervals between the centers of the respective columnar reflectors are as follows:

First Row
Diameter: 50 mm
Interval: 100 mm
Second Row
Diameter: 100 mm
Interval: 200 mm
Third Row
Diameter: 200 mm
Interval: 400 mm The distances between the rows (the center to center of the columnar reflectors) are fixed as follows:

Distance between the first and second rows: 80 mm
Distance between the second and third rows: 160 mm FIG. 14 is a conceptual diagram of the acoustic room, showing in a plan view an example where columnar reflectors were periodically arranged in three rows over a wall surface.

Figure 15:
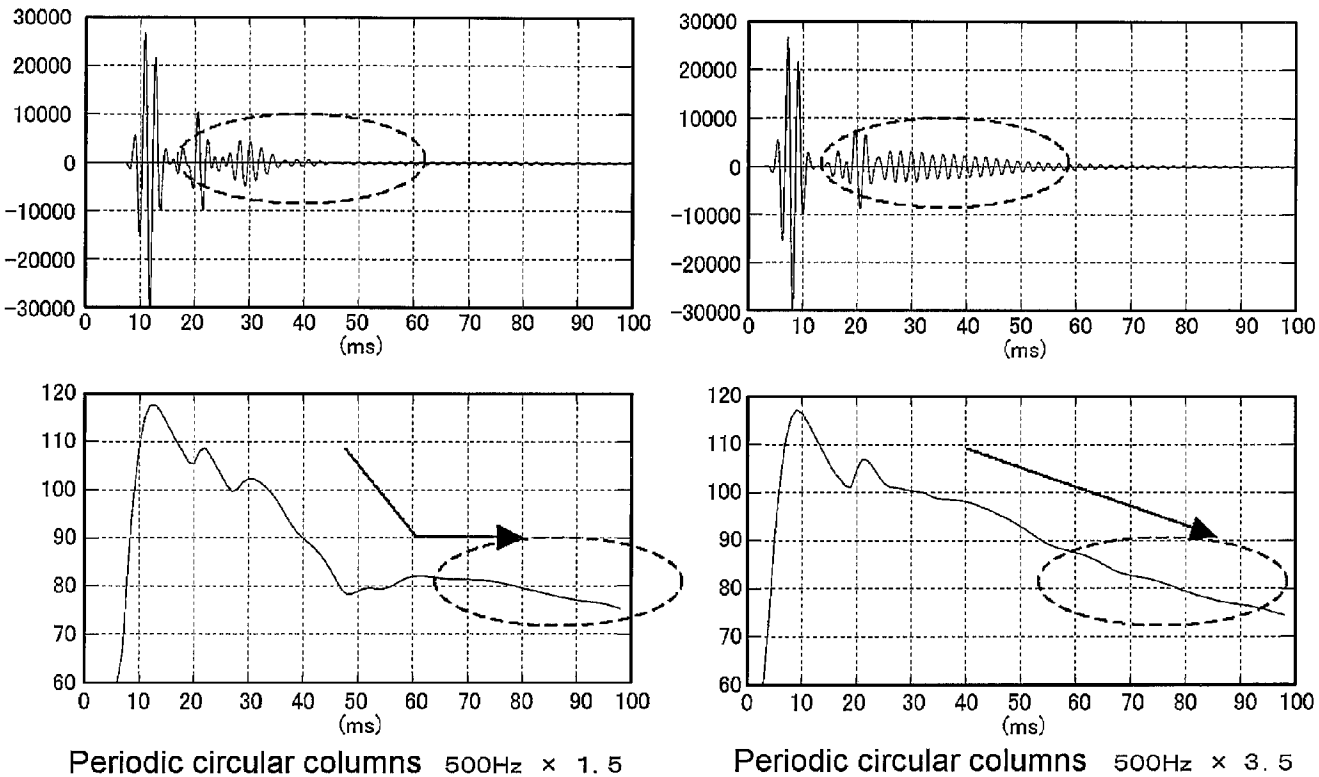
FIGS. 15*a* and 15*b* are graphs of the energy waveforms and time attenuation of reflected sound in a mid-low range according to Comparative Example 3 of the embodiment of the present invention.

FIG. 15 shows graphs of the time waveforms and energy attenuation (level attenuation) of reflected sound in the mid-low range of 500 Hz, showing the reflection on the wall surface with the periodically arranged circular columns. Again, FIG. 15(*a*) shows the graphs at the evaluation point A. FIG. 15(*b*) shows the graphs at the evaluation point B.

As conceptually shown by the arrows that indicate the gradients of level attenuation in FIG. 15, it can be seen that with such periodic columnar reflectors, the level attenuation differs between the evaluation points A and B. As shown by the elliptic wavy lines in FIG. 15, it can be seen that the reflected sound lasts long at 500 Hz. It is also shown that the evaluation points A and B have a large difference in the reflection property. That is, the sound field is far from favorable since the sense of reverberation varies from one listening position to another.

Figure 16:
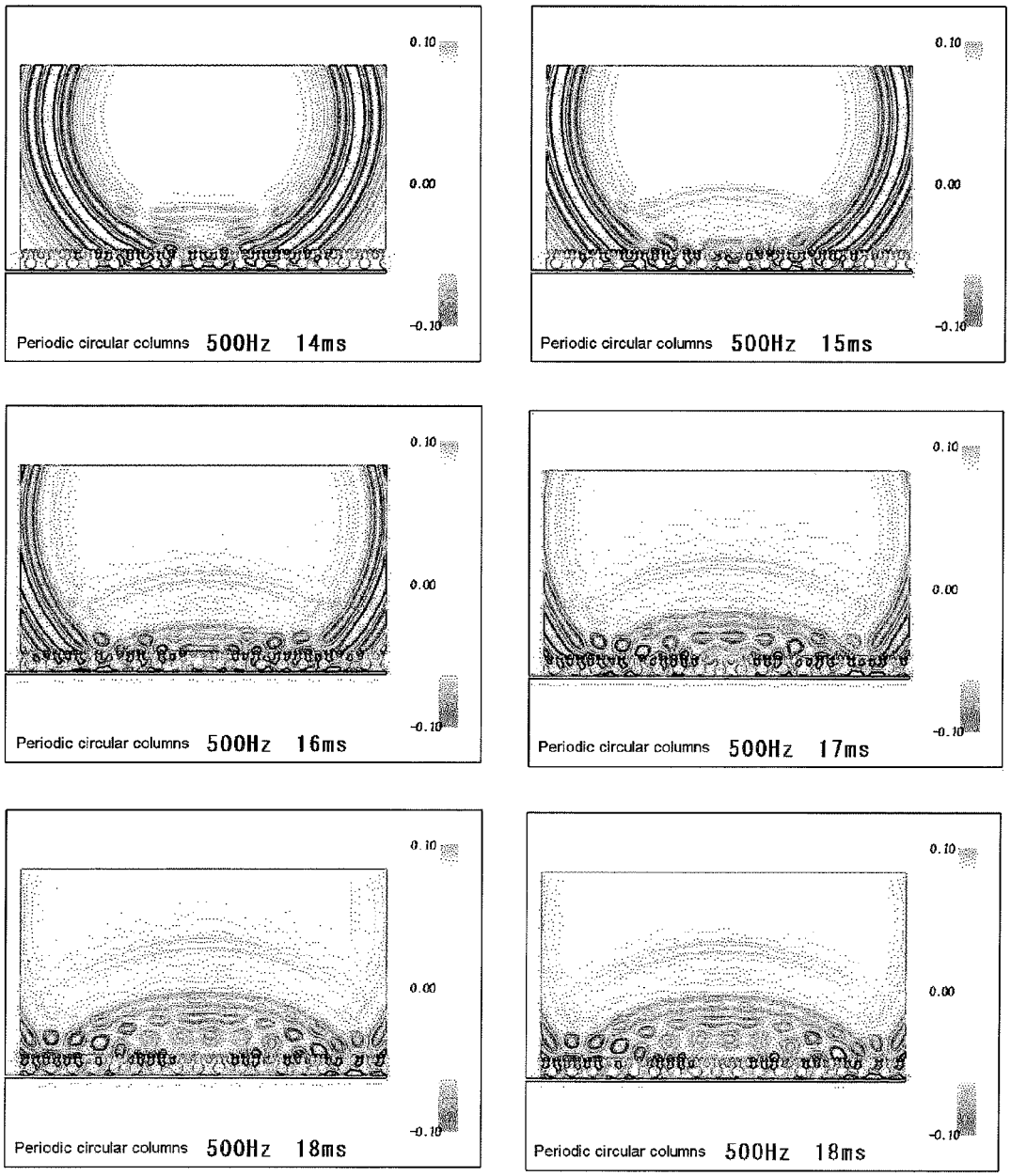
FIG. 16 is a diagram showing the result of a simulation of an instantaneous sound pressure distribution in the mid-low range according to Comparative Example 3 of the embodiment of the present invention.

FIG. 16 is a simulation result showing instantaneous sound pressure distributions at 500 Hz. The reflected sound waves are well diffused without much blocks of reflected sound as with the above-mentioned sound traps. However, a periodic pattern of stripes is observed. This shows that differences of the sound field appear periodically depending on the position.

Figure 17:
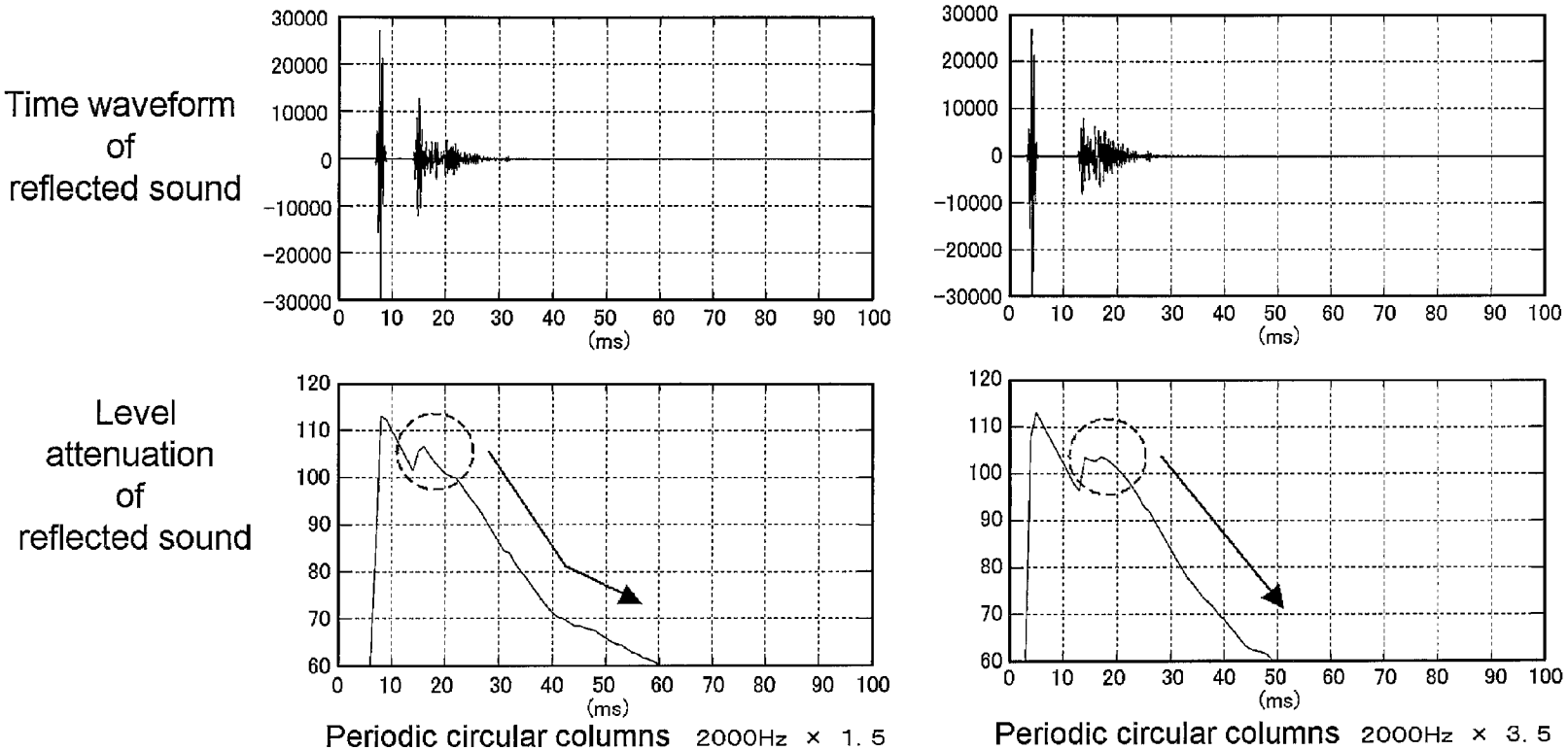
FIGS. 17*a* and 17*b* are graphs of the energy waveforms and time attenuation of reflected sound in a high range according to Comparative Example 3 of the embodiment of the present invention.

FIG. 17 is similar graphs of energy attenuation (level attenuation) in the high range of 2000 Hz. As with FIG. 15, it can be seen that the arrows indicating the gradients of level attenuation differ between the evaluation points A and B. As shown by the wavy-lined circles, the reflected waves have different properties at the evaluation points A and B.

A comparison between FIGS. 15 and 17 shows that the gradients of level attenuation differ significantly between 500 Hz and 2000 Hz. Such a difference can be a cause of "coloration" which is a reflection property specific to certain frequencies.

Figure 18:
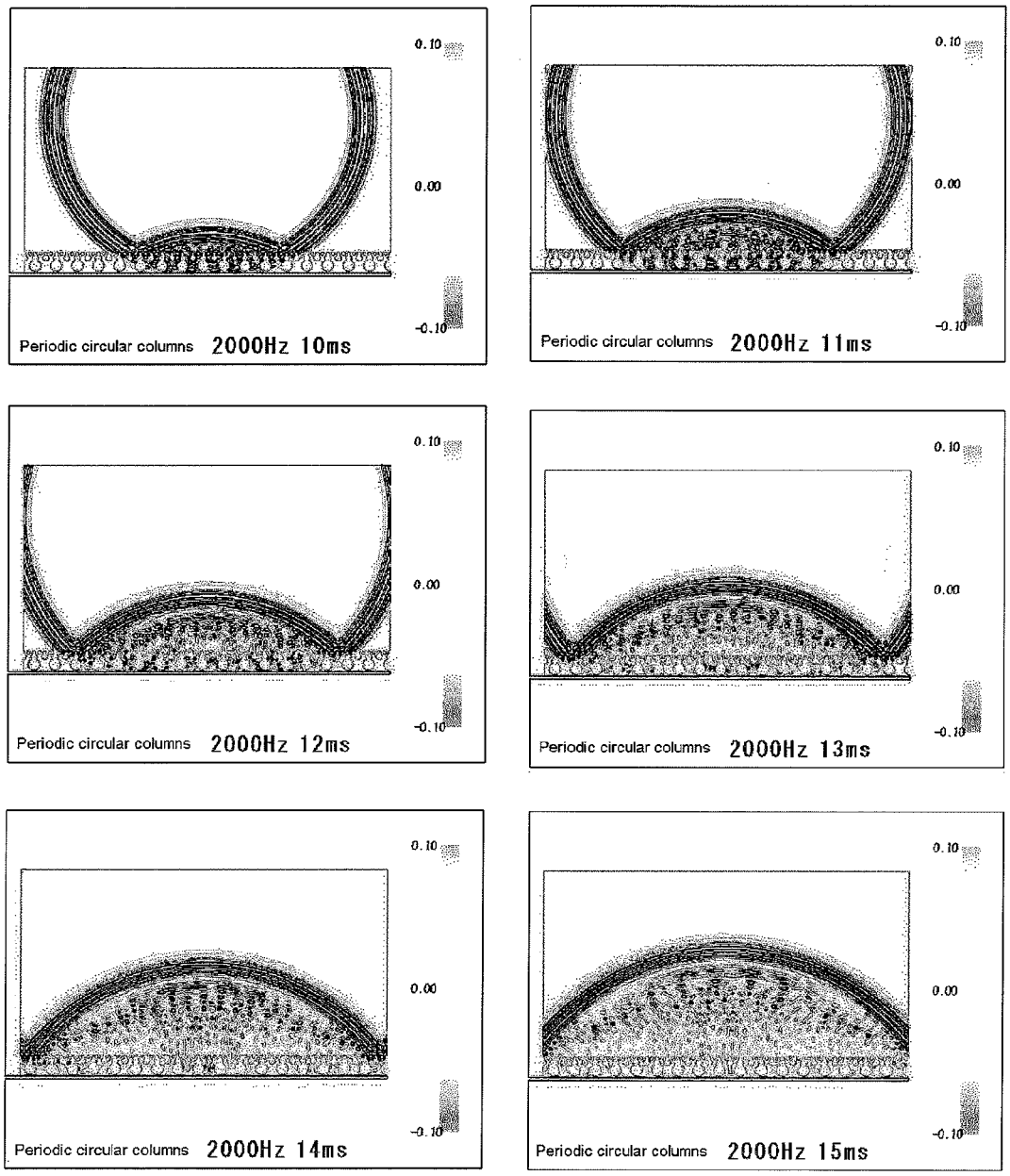
FIG. 18 is a diagram showing the result of a simulation of an instantaneous sound pressure distribution in the high range according to Comparative Example 3 of the embodiment of the present invention.

FIG. 18 is a simulation result showing instantaneous sound pressure distributions at 2000 Hz. The sound waves are diffused better than by oblique reflector plates, but with a periodic pattern of stripes. As in the case of 500 Hz, this shows that differences of the sound field appear periodically depending on the position.

Such periodic arrangement of columnar reflectors produces position-dependent differences in the level of level attenuation both in the high range and the mid-low range, causing coloration. Such a sound field is not suitable for various acoustic rooms.

Example 1

Finally, Example 1 will be described with reference to FIGS. 19 to 23.

Example 1 simulates an arrangement example where columnar reflectors are arranged in three rows, being at random in each row, with the diameters and arrangement condition according to the sound field adjusting method of the embodiment of the present invention.

Figure 19:
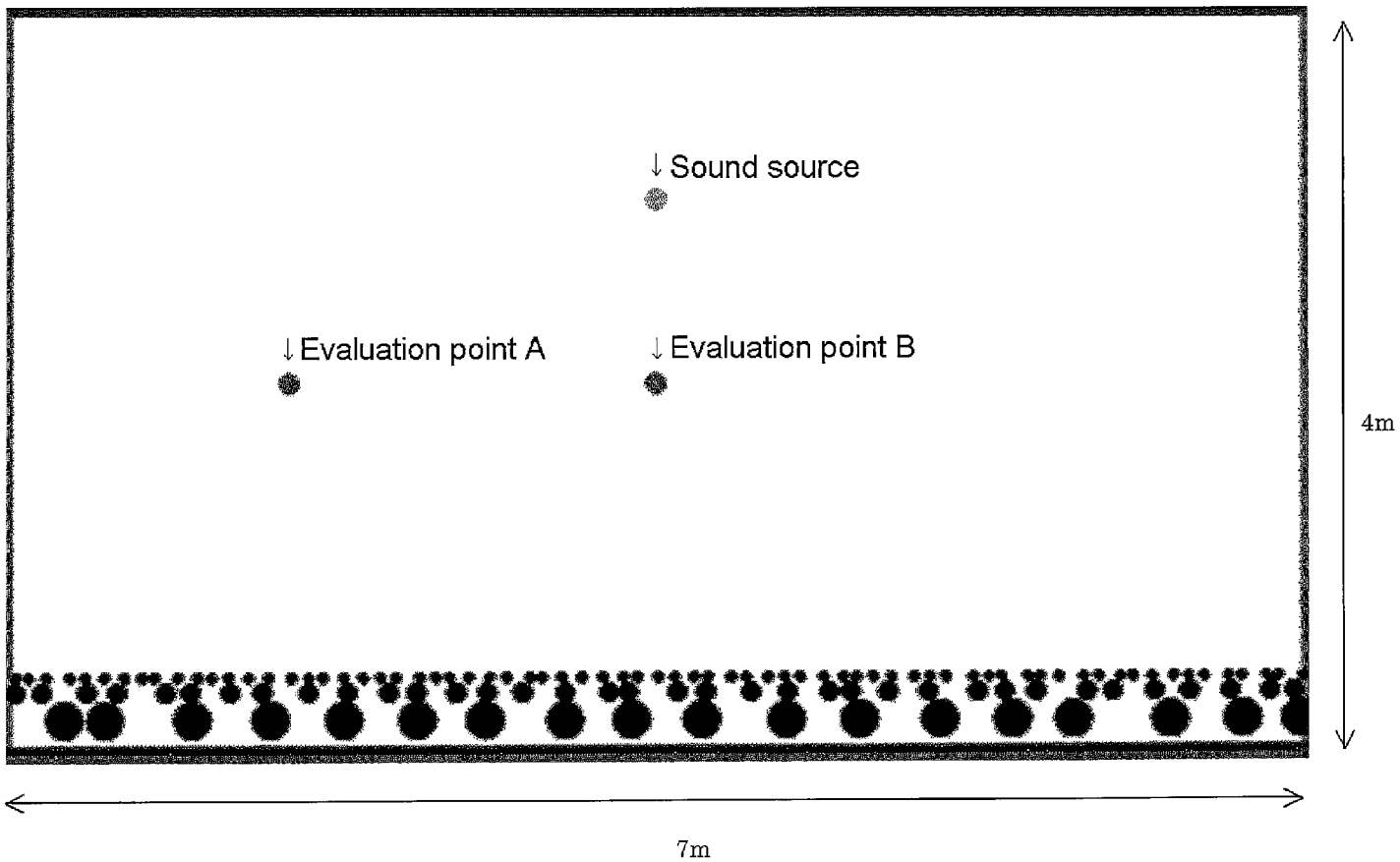
FIG. 19 is a conceptual diagram of the shape of an acoustic room in which simulation according to Example 1 of the embodiment of the present invention is performed.

FIG. 19 is a conceptual diagram of the acoustic room, showing in a plan view an example where columnar reflectors were arranged in three rows at random.

Figure 20:
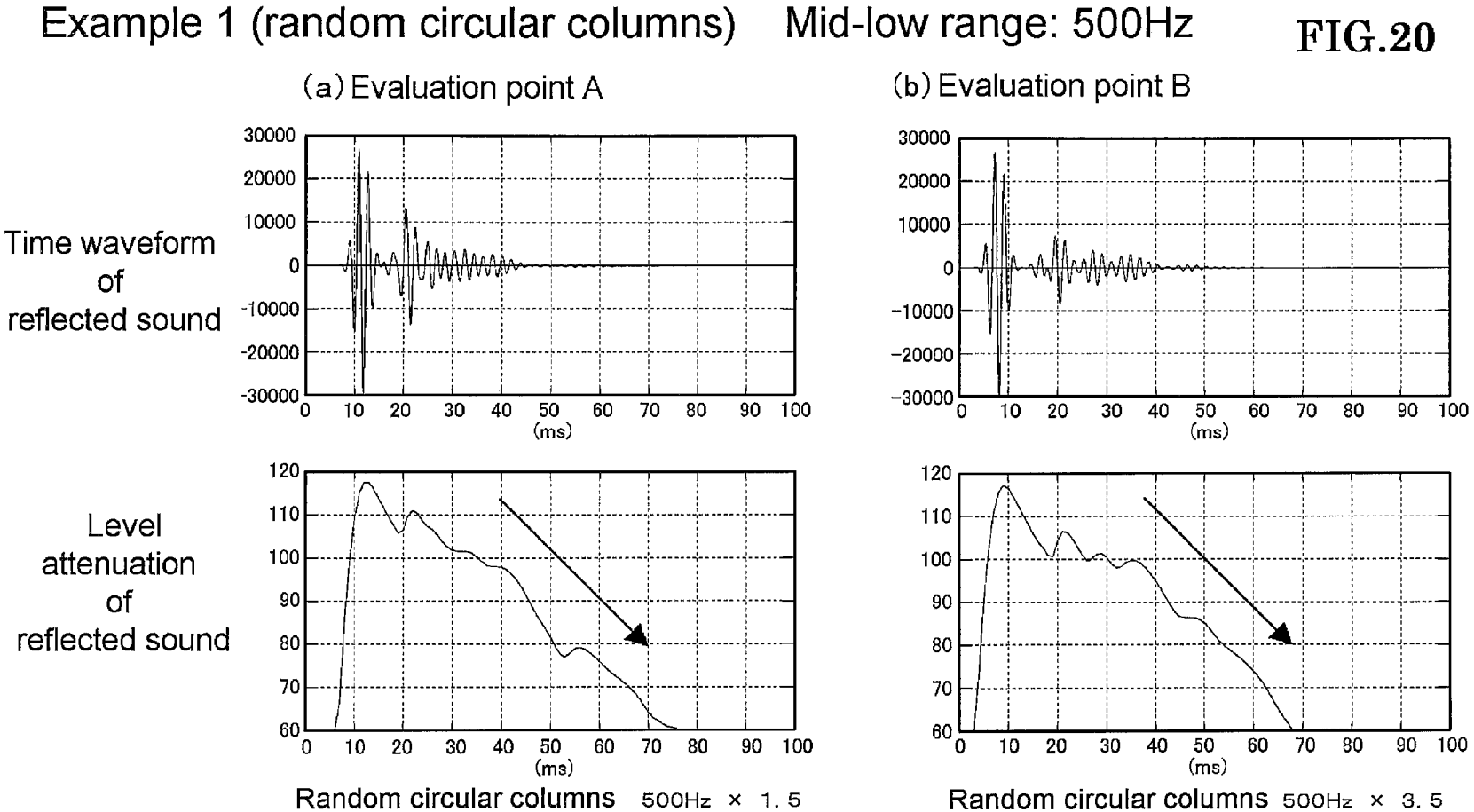
FIGS. 20*a* and 20*b* are graphs of the energy waveforms and time attenuation of reflected sound in a mid-low range according to Example 1 of the embodiment of the present invention.

In the acoustic room, the diameters and arrangement condition of the three-row (-stage) configuration were calculated as mentioned above. The diameters of the columnar reflectors in the respective rows, the intervals between the centers of the respective columnar reflectors, and the target frequencies (ranges) are as follows:

First Row
Diameter: 32 mm
Interval: 72 to 180 mm
Target frequency: 1000 Hz and above
Second Row
Diameter: 45 mm
Interval: 55 to 133 mm
Target frequency: approximately 630 Hz and above
Third Row
Diameter: 60 mm
Interval: 39 to 115 mm
Target frequency: approximately 500 Hz and above Also, the distances between the rows (the center to center of the columnar reflectors) are as follows:

Distance between the first and second rows: 45 mm
Distance between the second and third rows: 65 mm FIG. 20 shows graphs of the time waveforms and energy attenuation (level attenuation) of reflected sound in the mid-low range of 500 Hz, showing the reflection on the wall surface with the randomly arranged circular columns. Again, FIG. 20(*a*) shows the graphs at the evaluation point A. FIG. 20(*b*) shows the graphs at the evaluation point B.

It can be seen that with the wall surface having the randomly-arranged circular columns, the reflected sound is diffused better than by only a wall (Comparative Example 1), oblique reflector plates (Comparative Example 2), and periodic circular columns (Comparative Example 3), and thus provides mild natural reverberations. It can also be seen that the sound receiving points A and B have not much difference in the gradient of level attenuation, nor much difference in the gradient of attenuation time and in the time to attenuation. In other words, it can be seen that it is possible to provide a uniform high-quality sound field over a wide range, without much position-dependent differences in the reflection property.

Figure 21:
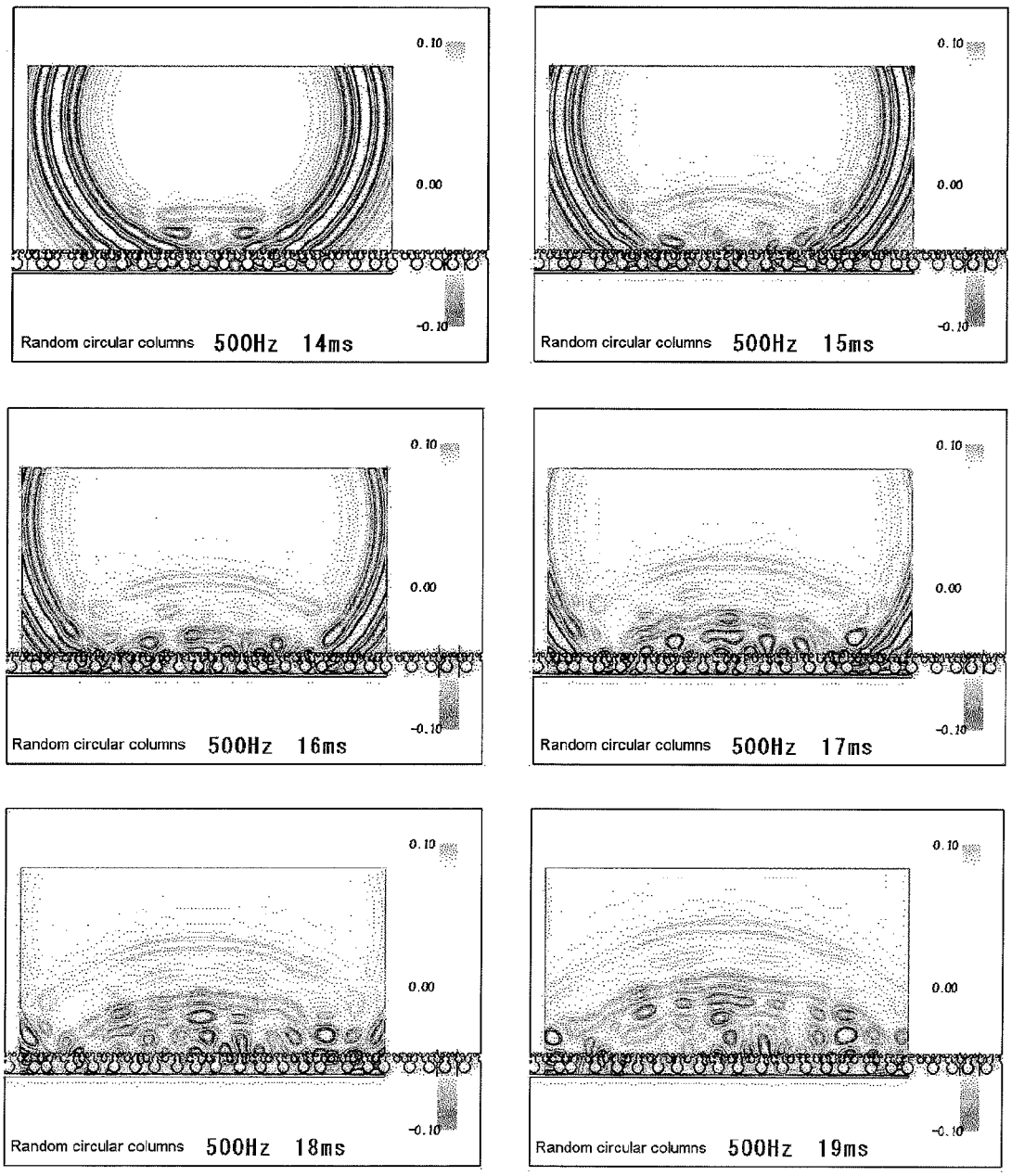
FIG. 21 is a diagram showing the result of a simulation of an instantaneous sound pressure distribution in the mid-low range according to Example 1 of the embodiment of the present invention.

FIG. 21 is a simulation result showing instantaneous sound pressure distributions at 500 Hz. Again, as compared to the foregoing comparative examples, it can be seen that the areas where strong sound waves are observed vary with time as shown by the wavy-lined ellipses. This shows that the reflected sound is finely diffused into a wide range. That is, it can be seen that the resulting diffusion is uniform without much differences between the sound receiving points.

Figure 22:
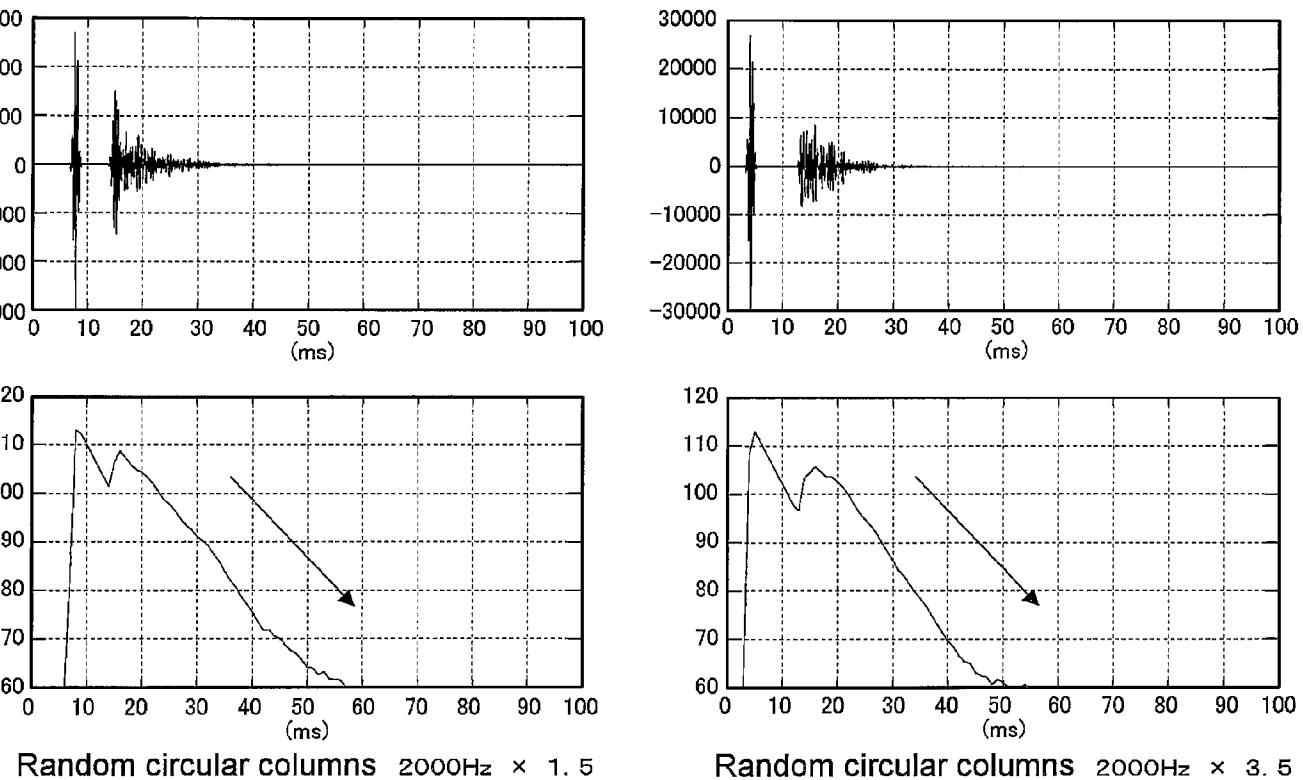
FIGS. 22*a* and 22*b* are graphs of the energy waveforms and time attenuation of reflected sound in a high range according to Example 1 of the embodiment of the present invention.

FIG. 22 is similar graphs of energy attenuation (level attenuation) at 2000 Hz. Again, as compared to Comparative Examples 1 to 3, it can be seen that the sound receiving points A and B have not much difference in the gradient of level attenuation nor much difference in the time to attenuation, and there is provided a uniform high-quality sound field over a wide range. That is, the result is mild natural reverberations.

Figure 23:
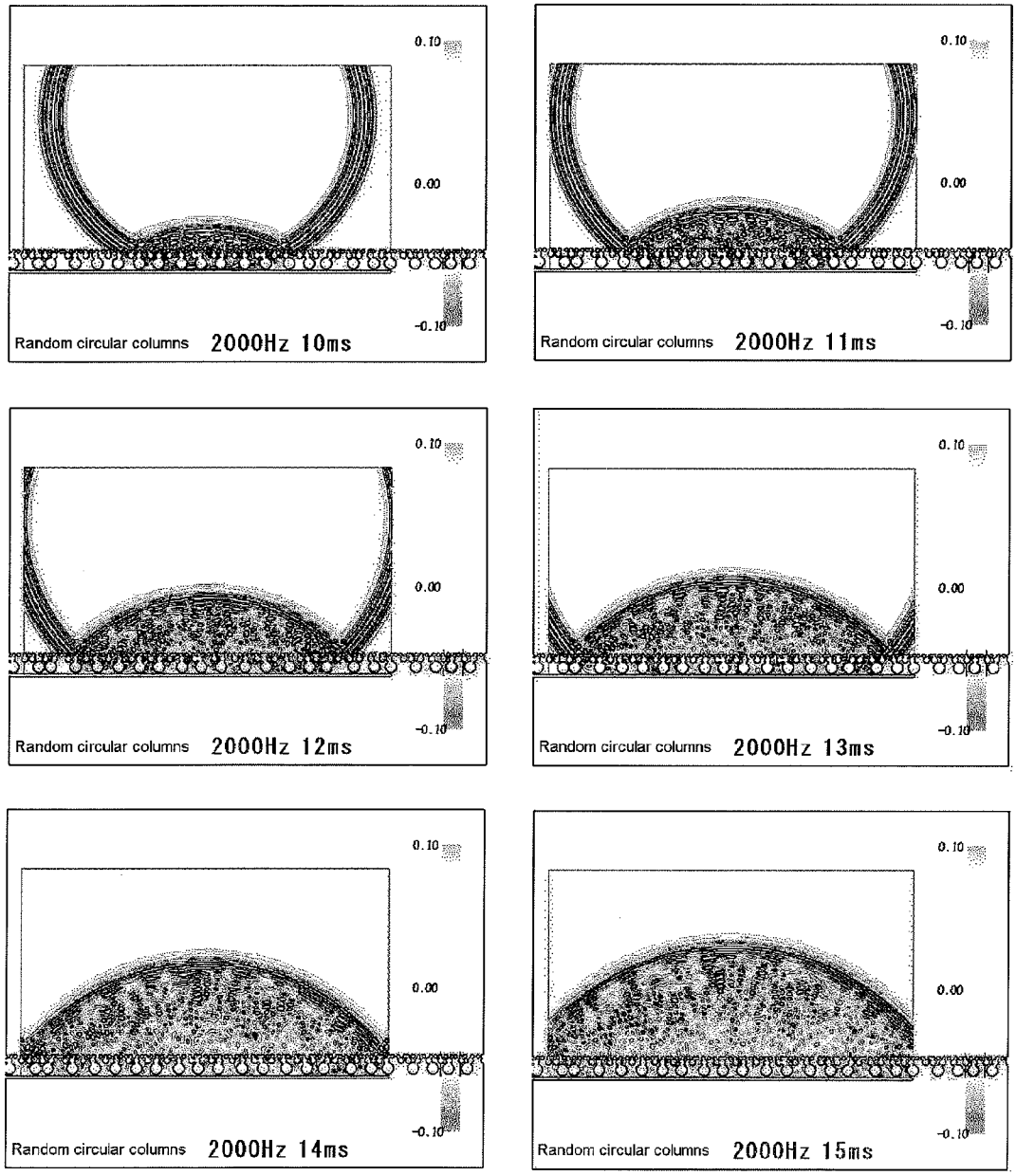
FIG. 23 is a diagram showing the result of a simulation of an instantaneous sound pressure distribution in the high range according to Example 1 of the embodiment of the present invention.

FIG. 23 is a simulation result showing instantaneous sound pressure distributions at 2000 Hz. As shown here, it can be seen that the reflected sound is finely and well diffused as a whole. There are few periodic patterns of stripes as with the periodic circular columns of FIG. 18, and the areas of strong sound waves vary with time in each location. In other words, a uniform sound field is provided.

Consequently, the sound field adjusting method according to the embodiment of the present invention can be used to provide acoustically excellent various acoustic rooms.

[Comparison of Diffusibility of Sound Waves]

Then, side walls were compared for diffusibility by a similar simulation.

The simulation can calculate and depict the densities of diffuse waves when sound waves reach the side walls, from which it can be seen whether a uniform sound field is created or not.

Comparative Example 4

Figure 24:
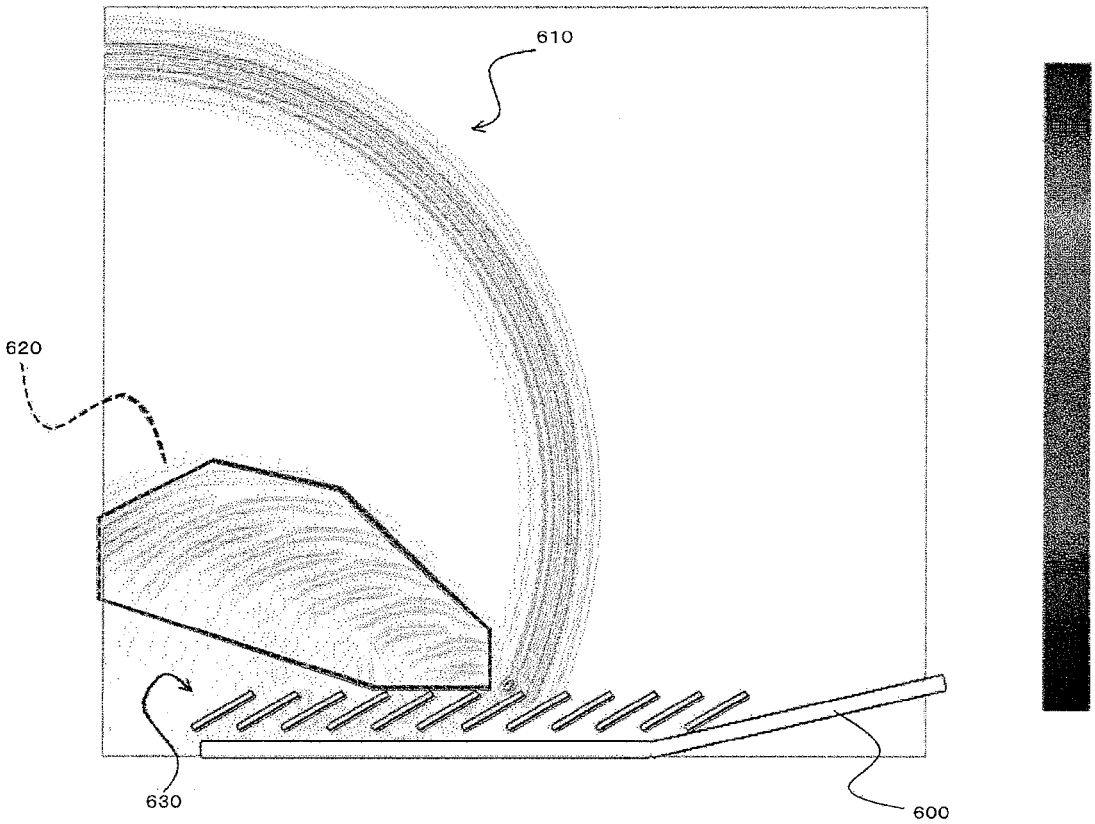
FIG. 24 is a diagram showing the distribution of wavefronts of sound waves when the sound waves are reflected by acoustic diffusers according to conventional Comparative Example 4.

Referring to FIG. 24, description will be given of a simulation where the foregoing sound traps were used.

A wall surface 600 represents a concrete wall having a thickness of 100 mm.

Sound wavefronts 610 are the graphic representation of the energy of sound waves that are output from a single sound source.

Diffuse wavefronts 620 are the graphical representation of the energy of soundwaves that result from the reflection and diffusion of the sound waves of the sound wavefronts 610.

A group of sound traps 630 was the simulated sound traps. As in the foregoing Comparative Example 2, the group of sound traps 630 had a width of 450 mm and an arrangement pitch of 300 mm, and were obliquely arranged at 45° with respect to the wall surface 600.

As a result of the simulation, the diffuse wavefronts 620 show that the reflected waves are radiated almost in one direction with not much diffusion, and the wavefronts only reach a narrow area.

Such a state means that the location where the sound field environment is favorable ("sweet spot") is narrow, so that the sound field is not favorable.

Example 2

Figure 25:
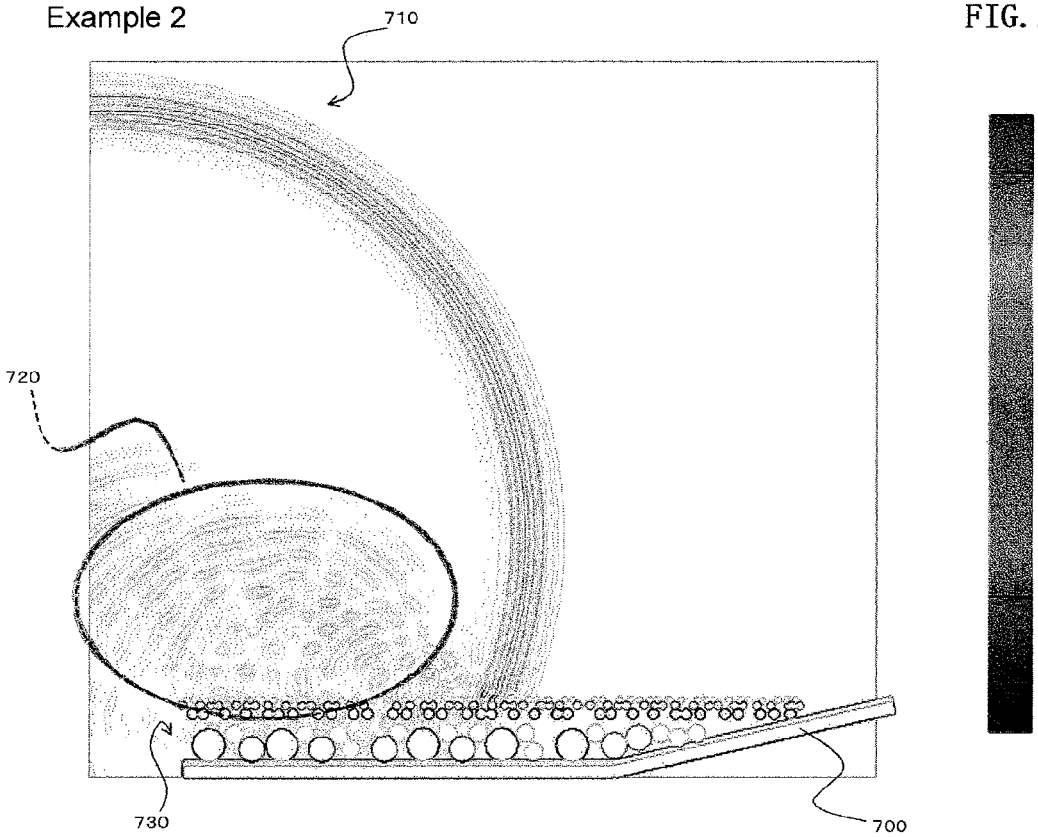
FIG. 25 is a diagram showing the distribution of wavefronts of sound waves when the sound waves are reflected by columnar reflectors according to Example 2 of the embodiment of the present invention.

As refer to FIG. 25, description will be given of a simulation with columnar reflectors whose diameters and arrangement condition were calculated by the sound field adjusting method according to the embodiment of the present invention.

A wall surface 700 represents the same concrete wall having a thickness of 100 mm as in Comparative Example 4.

Sound wavefronts 710 are the graphic representation of the energy of sound waves that are output from a single sound source like the wavefronts 610.

Diffuse wavefronts 720 show the energy of sound waves that result from the reflection and diffusion of the sound waves of the sound wavefronts 710.

The diameters of the columnar reflectors in the respective rows of a group of columnar structural members 730, the intervals between the centers of the respective columnar reflectors, and the target frequencies (bands) are as follows:

First Row
Diameter: 32 mm
Interval: 72 to 180 mm
Target frequency: 1000 Hz and above
Second Row
Diameter: 45 mm
Interval: 55 to 133 mm
Target frequency: approximately 630 Hz and above
Third Row
Diameter: 60 mm
Interval: 39 to 115 mm
Target frequency: approximately 500 Hz and above
Fourth Row
Diameter: 115 mm, 165 mm, or 216 mm
Interval: random in the range of 60 to 210 mm
Target frequency: 500 Hz and below The distances between the rows (the center to center of the columnar reflectors) are fixed as follows:

Distance between the first and second rows: 45 mm
Distance between the second and third rows: 65 mm
Distance between the third and fourth rows: approximately 125 to 204 mm (rough dimensions due to the random arrangement)

The fourth row may be subdivided and arranged as a 115-mm fourth row, a 165-mm fifth row, and a 216-mm sixth row, whereas the three types of circular columns were mixed and arranged at random both in terms of rows and columns in view of construction space and convenience.

Since low tones have low directivity, such a random arrangement produces not much differences and is thus effective.

From the result of the simulation, it can be seen that the diffuse wavefronts 720 are quite uniformly radiated as compared to the diffuse wavefronts 620.

The reflected waves have no wavefront blocks, which indicates of uniform diffusion.

Unlike the diffuse wavefronts 620, the diffuse wavefronts 720 show that the energy of the soundwaves is diffused and distributed over a wide range of directions.

In view of such results, it is possible to achieve a uniform sound field with a wider sweet spot than with the conventional acoustic diffusers by using "sound traps."

It can thus be seen that a more favorable sound field can be provided by the sound field adjusting method according to the embodiment of the present invention.

[Comparison of Acoustic Material Parameters of Reflector Structure]

The reflector structure according to the embodiment of the present invention was measured for a change in the sound pressure reflectance (phase) in each frequency range in terms of a complex reflection coefficient, and examined for acoustic material parameters. In the measurement, sound was produced toward a rigid wall 800, and a change in the sound pressure reflectance (phase) was measured depending on the presence or absence of a round bar 810, the thickness of the same, and the presence or absence of a sound absorbing material 820. A change in phase and the occurrence of a time delay were also checked for in each frequency range.

As refer to FIG. 26(*a*), the concept of the measurement of acoustic material parameters in Comparative Example 5, Example 3, Example 4, and Example 5 will be described. The arrow indicates the incident direction of the sound from the sound source.

In Comparative Example 5, Example 3, Example 4, and Example 5, there was arranged no sound absorbing material 820.

The reflector structure was a round bar 810 having a curved reflecting surface.

Comparative Example 5 used no round bar 810. As shown in FIG. 26(*a*), Example 3 included a ϕ114-mm round bar 811. Example 4 included a ϕ164-mm round bar 812. Example 5 included a ϕ216-mm round bar 813. The round bar 810 was installed so that the top of the round bar 810 as seen from the sound source was located 400 mm from the rigid wall 800.

Hereinafter, the measurement results of the acoustic material parameters will be described in more detail in order of Comparative Example 5, Example 3, Example 4, and Example 5.

Comparative Example 5

Figure 26:
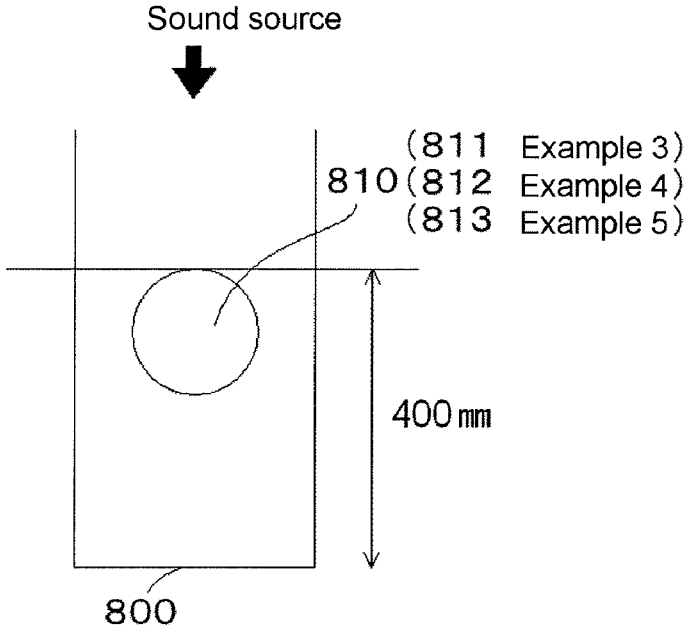
FIG. 26(*a*) is a diagram showing the concept of the measurement of an acoustic material parameter according to Comparative Example 5 and Examples 3 to 5 of the embodiment of the present invention, and FIG. 26(*b*) is a chart showing the measurement results of the acoustic material parameter.
Figure 26:
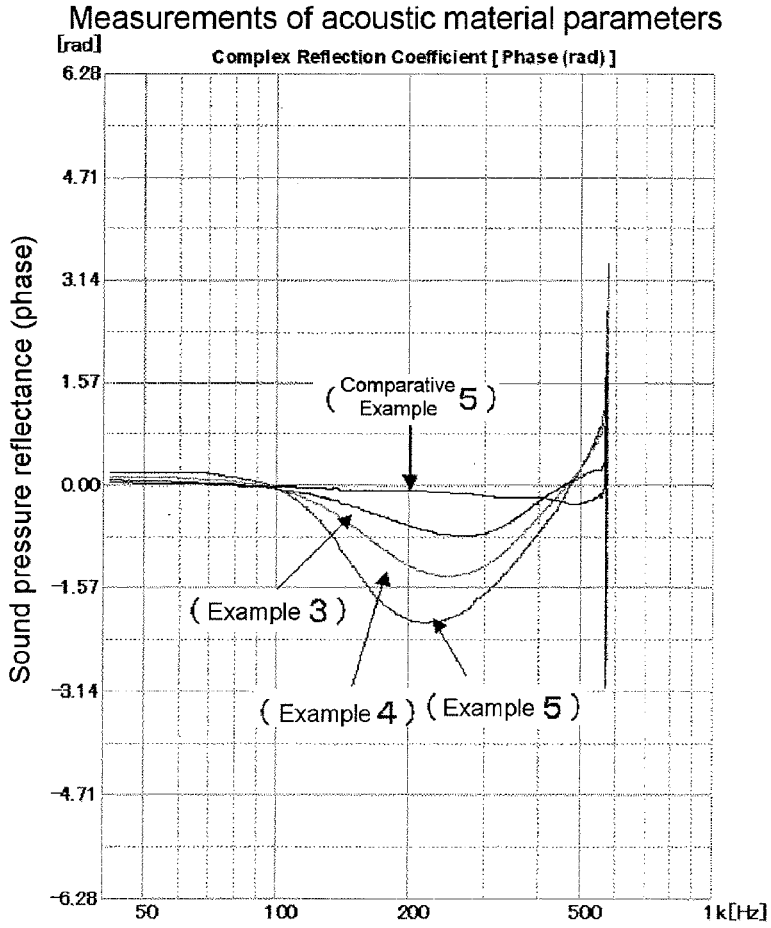

Referring to FIG. 26(*b*), description will be given of the measurement result of the sound pressure reflectance (phase) when there was no reflector structure.

In such a case, the measurement of the sound pressure reflection number (phase) was near 0 in all the frequency ranges. That means that neither phase change nor time delay occurs in any of the frequency ranges.

Example 3

Next, referring to FIG. 26(*b*), description will be given of the measurement result of the sound pressure reflectance (phase) when there is a reflector structure.

When the ϕ114-mm round bar 811 was used as the reflector structure, the sound pressure reflectance (phase) started changing in phase toward negative values in the vicinity of 100 Hz, causing a time delay. The phase change toward negative values peaked near 266 Hz. In the frequency range of 500 Hz and above, the change turned to positive values.

Example 4

Referring to FIG. 26(*b*), description will also be given of the measurement result of the sound pressure reflectance (phase) when there is a reflector structure.

When the ϕ164-mm round bar 812 was used as the reflector structure, the sound pressure reflectance (phase) started changing in phase toward negative values in the vicinity of 100 Hz, causing a time delay. The phase change toward negative values peaked near 247 Hz. In the frequency range of 500 Hz and above, the change turned to positive values.

As compared to Example 3, the change from 0 was greater in value. The position of the negative peak was shifted toward lower frequencies.

Example 5

Referring to FIG. 26(*b*), description will also be given of the measurement result of the sound pressure reflectance (phase) when there is a reflector structure.

When the ϕ216-mm round bar 813 was used as the reflector structure, the sound pressure reflectance (phase) started changing in phase toward negative values in the vicinity of 100 Hz, causing a time delay. The phase change toward negative values peaked near 215 Hz. In the frequency range of 500 Hz and above, the change turned to positive values.

As compared to Example 3 and Example 4, the change from 0 was greater in value. The position of the negative peak was shifted toward yet lower frequencies.

According to Comparative Example 5, Example 3, Example 4, and Example 5, the soundwaves of the target frequency range circumvent the round bar 810 with a time delay depending on the diameter. The result is equivalent to when the rear space is reduced as much as the volume occupied by the round bar 810. A time lead occurs in the range above the target frequency range. The reason is the reflection at the surface of the round bar 810. In the range below the target frequency range, the measurement of the sound pressure reflectance (phase) is near 0. That is, the round bar 810 is ignored and simply passed by.

As seen above, the sound pressure reflectance (phase) changes characteristically and corresponds to acoustic frequency, depending on the diametric dimension and size of the reflector structure. Reflector structures of thicker (greater) diameters can be used to adjust a time delay in lower frequency ranges. Reflector structures of thinner (smaller) diameters can be used to adjust a time delay in higher frequency ranges.

The diametric dimension and size of the reflector structure can thus be adjusted to create various reflections and intentionally adjust the reflection time. Various effects also occur depending on the angle of incidence.

As refer to FIG. 27(*a*), the concept of the measurement of acoustic material parameters in Comparative Example 6, Example 6, and Example 7 will be described. The arrow indicates the incident direction of the sound from the sound source.

The sound absorbing material 820 was GW24k50t.

The reflector structure was a round bar or round bars 810 having a curved reflecting surface.

Comparative Example 6 used no round bar 810. As shown in FIG. 27(*a*), Example 6 included only a ϕ216-mm round bar 813. Example 7 included a total of two round bars, a ϕ114-mm round bar 811 and a ϕ216-mm round bar 813. Dimensions of 200 mm and 400 mm will be indicated on the right of FIG. 27(*a*).

Hereinafter, the measurement results of the acoustic material parameters will be described in more detail in order of Comparative Example 6, Example 6, and Example 7.

Comparative Example 6

Figure 27:
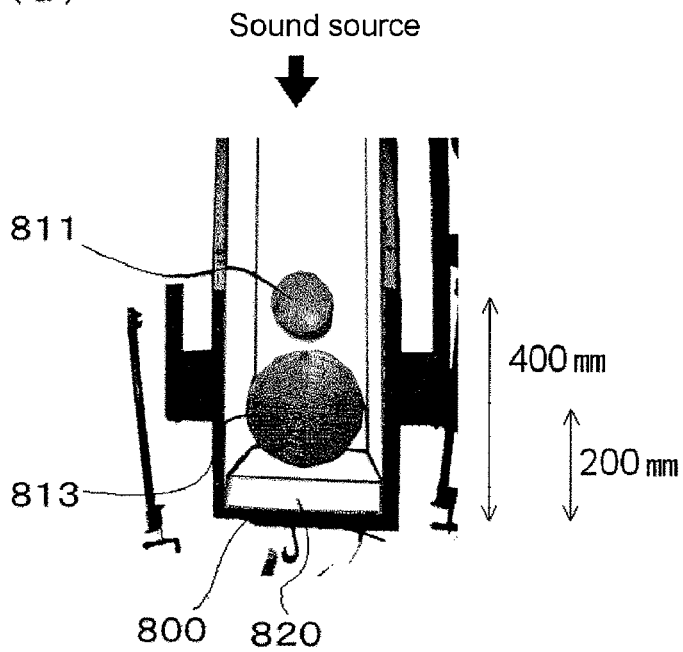
FIG. 27(*a*) is a diagram showing the concept of the measurement of an acoustic material parameter according to Comparative Example 6 and Examples 6 and 7 of the embodiment of the present invention, and FIG. 27(*b*) is a chart showing the measurement results of the acoustic material parameter.
Figure 27:
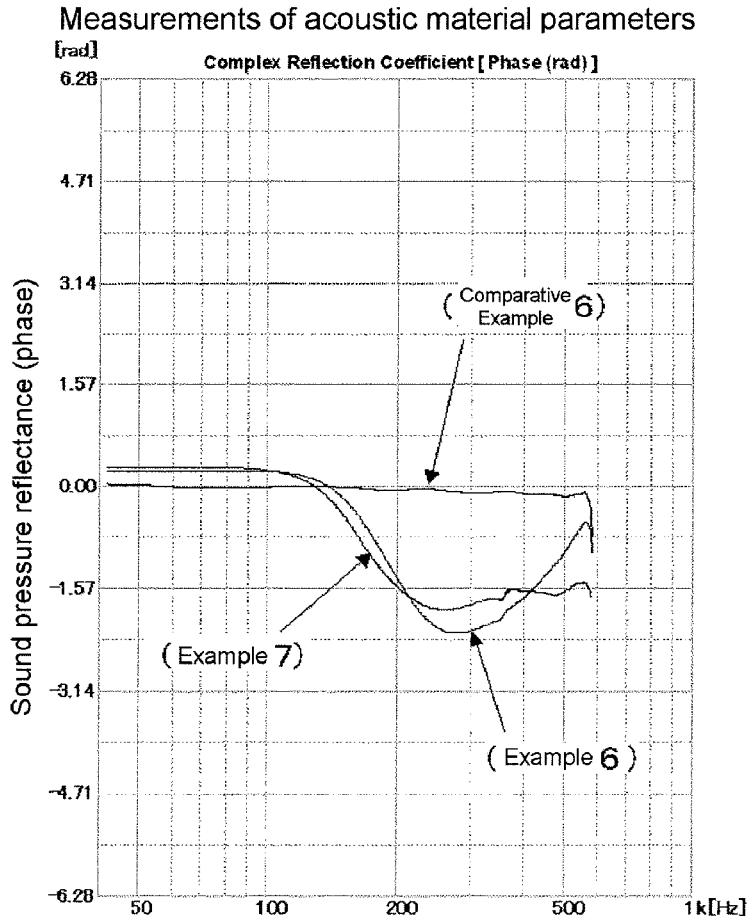

Referring to FIG. 27(*b*), description will be given of the measurement result of the sound pressure reflectance (phase) when there was the sound absorbing material 820 (GW24k50t) but no reflector structure.

In such a case, the measurement of the sound pressure reflection number (phase) was near 0 in all the frequency ranges. That means that neither phase change nor time delay occurred in any of the frequency ranges, and a change in phase was independent of the sound absorbing material 820.

Example 6

Referring to FIG. 27(*b*), description will be given of the measurement result of the sound pressure reflectance (phase) when there was the sound absorbing material 820 (GW24k50t) along with a reflector structure.

When only the ϕ216-mm round bar 813 was used as the reflector structure, the sound pressure reflectance (phase) started changing in phase toward negative values in the vicinity of 150 Hz, causing a time delay. The phase change toward negative values peaked near 276 Hz.

Example 7

As refer to FIG. 27(*b*), description will be given of the measurement result of the sound pressure reflectance (phase)

when there was the sound absorbing material 820 (GW24k50t) along with a reflector structure.

When a total of two round bars, the ϕ114-mm round bar 811 and the ϕ216-mm round bar 813, were used as the reflector structure, the sound pressure reflectance (phase) started changing in phase toward negative values in the vicinity of 150 Hz, causing a time delay. The phase change toward negative values peaked near 260 Hz. As compared to Comparative Example 6 and Example 6, the frequency range where the phase varied from 0 was wider. Such arrangement of a plurality of round bars 810 with the diameters increasing with an increasing distance from the sound source produces an additional synergistic effect of multilayer reflection between the arranged round bars 810, as compared to the mode of reflection with the singular arrangement.

If a round bar 810 of greater diameter lies in front of a round bar 810 of smaller diameter with respect to the sound source, the sound pressure reflectance is dominated by the round bar 810 of greater diameter. On the other hand, if the round bar 810 of smaller diameter lies in front of the round bar 810 of greater diameter with respect to the sound source, there occur additional scattered reflections due not only to the diffusion effect of each round bar 810 but also to synergistic effects including the multilayer reflection between the round bars 810.

Consequently, when the direction of entry of sound is from the reflector structure of thinner (smaller) diameter to the reflector structure of thicker (greater) diameter, the sound acts smoothly in the vicinities of the reflector structures. This provides the effect that the impedance changes smoothly from lower to higher values.

Figure 28:
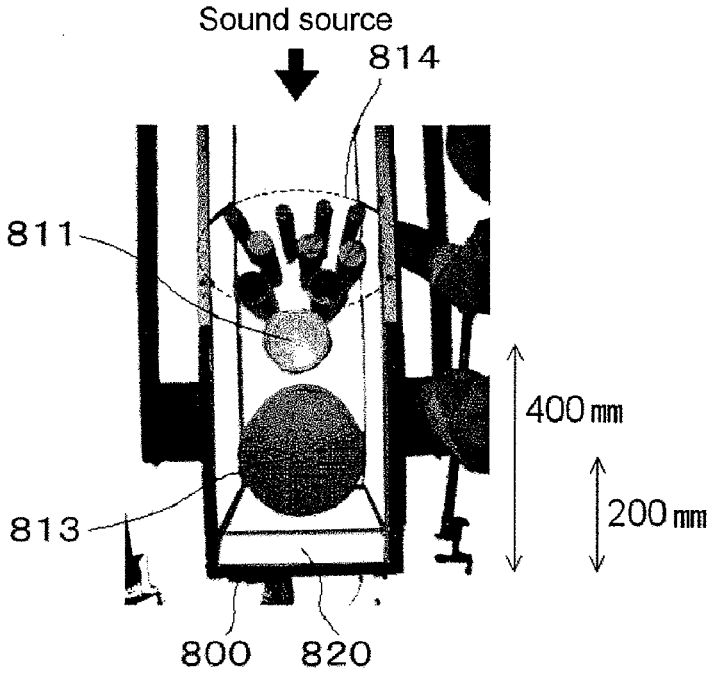
FIG. 28(*a*) is a diagram showing the concept of the measurement of an acoustic material parameter according to Comparative Example 6 and Examples 6 to 9 of the embodiment of the present invention, and FIG. 28(*b*) is a chart showing the measurement results of the acoustic material parameter.
Figure 28:
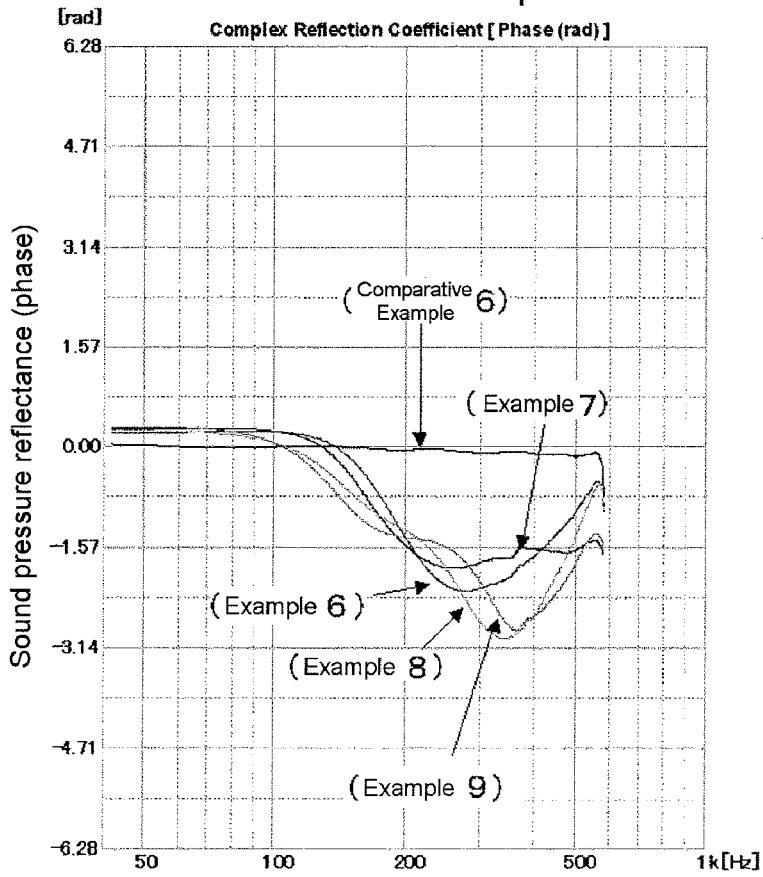

Referring to FIG. 28(*a*), the concept of the measurement of acoustic material parameters in Example 8 and Example 9 will be described. The arrow indicates the incident direction of the sound from the sound source.

The sound absorbing material 820 was GW24k50t.

The reflector structure was a round bar or round bars 810 having a curved reflecting surface.

Example 8 included a ϕ216-mm round bar 813 and a group of small round bars 814. Example 9 included a ϕ114-mm round bar 811, a ϕ216-mm round bar 813, and a group of small round bars 814. The group of small round bars 814 includes two ϕ60-mm, three ϕ45-mm, and four ϕ30-mm round bars which are arranged as shown in FIG. 28(*a*). Dimensions of 200 mm and 400 mm will be indicated on the right of FIG. 28(*a*).

Hereinafter, the measurement results of the acoustic material parameters will be described in more detail in order of Example 8 and Example 9.

Example 8

Referring to FIG. 28(*b*), description will be given of the measurement result of the sound pressure reflectance (phase) when there was the sound absorbing material 820 (GW24k50t) along with a reflector structure.

When the ϕ216-mm round bar 813 and the group of small round bars 814 were used as the reflector structure, the sound pressure reflectance (phase) started changing in phase toward negative values in the vicinity of 100 Hz, causing a delay in reflection time. The phase change toward negative values peaked near 342 Hz. As compared to Examples 6 and 7, the frequency range where the phase varied from 0 was wider, with the variations greater in value.

Example 9

Referring to FIG. 28(*b*), description will be given of the measurement result of the sound pressure reflectance (phase) when there was the sound absorbing material 820 (GW24k50t) along with a reflector structure.

When the ϕ114-mm round bar 811, the ϕ216-mm round bar 813, and the group of small round bars 814 were used as the reflector structure, the sound pressure reflectance (phase) started changing in phase toward negative values in the vicinity of 100 Hz, causing a time delay. The phase change toward negative values peaked near 371 Hz. As compared to Examples 6 and 7, the frequency range where the phase varied from 0 was wider, with the variations greater in value. As compared to Example 8, the variations from 0 were greater in value.

Consequently, it is shown that when round bars 810 arranged farther from the sound source have a greater diameter or thickness that that of round bars 810 closer to the sound source, there are formed a greater number of reflecting surfaces that make random the reflection directions and/or reflection time delays of sound waves of different frequency ranges or the phases of reflected sound. A greater number of round bars 810 can be combined for the effect of producing a greater diversity of diffuse sounds.

The foregoing Comparative Examples 5 and 6 and Examples 3 to 9 can be the to have measured the actual values of the parameters on the acoustic impedances of the columnar reflectors in a normal incident tube (see FIGS. 26(*b*), 27(*b*), and 27(*b*)).

According to the measurements, the phase part of the complex reflectance of the ϕ216-mm round bar 813 (large tube) has an intrinsic phase shift in its intrinsic frequency range in charge. When the ϕ114-mm round bar 811 (medium tube) is arranged in front (on the sound-source side) of the large tube at a predetermined interval, the characteristics of the large tube and those of the medium tube are observed as if added to each other.

It is also shown that the group of small round bars 814 (group of small tubes) can be arranged in front without a change in the basic characteristics of the large and medium tubes. It can be seen that the large tube, the medium tube, and the group of small tubes cause no peculiar phenomenon such as coloration therebetween.

The columnar reflectors according to the embodiment of the present invention are a combination of columnar reflectors of different diameters, and thus have intrinsic impedances depending on the frequency. Even in such examples, it can be seen that impedance matching can be performed favorably.

[Comparison of Sound Absorption Coefficients of Reflector Structure]

The reflector structure according to the embodiment of the present invention was measured for a sound absorption coefficient by a reverberation room method in each frequency range, and examined for a change in the sound absorption coefficient. In the measurement, the change in the sound absorption coefficient was measured by letting sound pass round bars 810 and sound absorbing materials 821 and 822. The sound absorption coefficient in each frequency range was then considered for a change.

It should be appreciated that when only the sound absorbing materials 821 and 822 are used without any reflector structure according to the embodiment of the present invention, excessive sound absorption occurs in high frequency ranges in particular.

Figure 29:
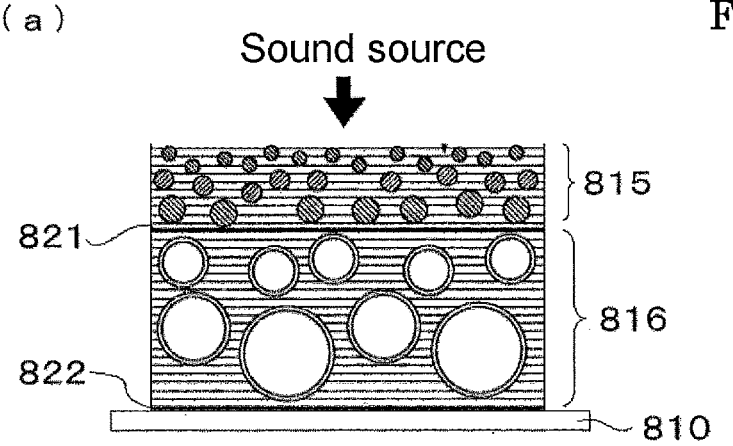
FIG. 29(*a*) is a diagram showing the concept of the measurement of sound absorption coefficients of reflector structures according to Examples 10 to 13 of the embodiment of the present invention, and FIG. 29(*b*) is a chart showing the measurement results of the sound absorption coefficients of the reflector structures.
Figure 29:
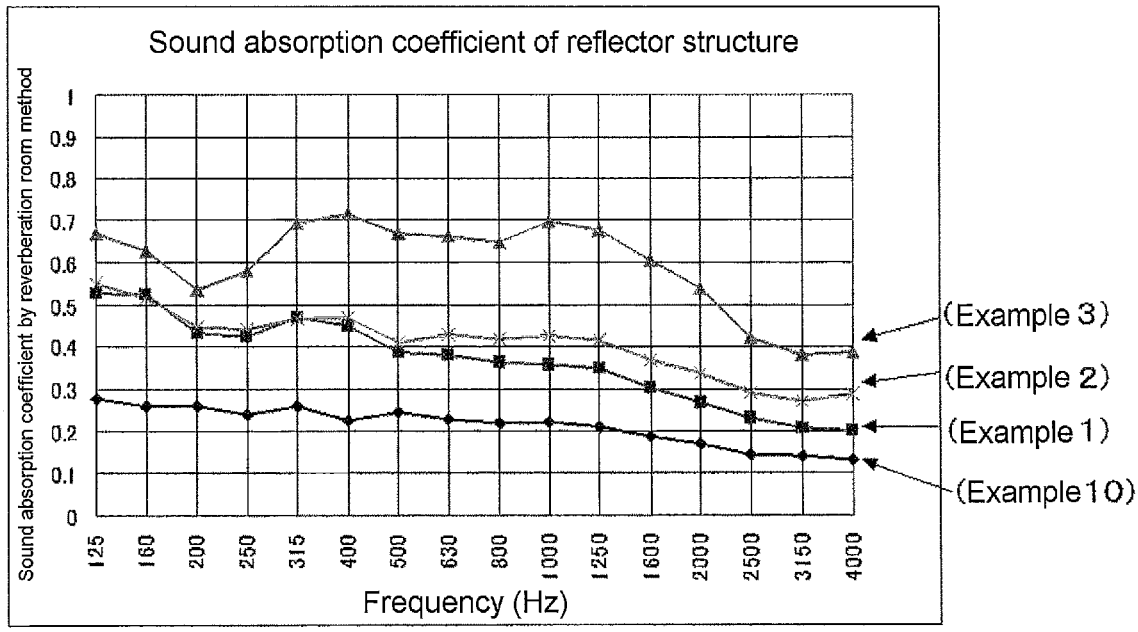

Referring to FIG. 29(*a*), the concept of the measurement of the sound absorption coefficient of the reflector structure in Example 10, Example 11, Example 12, and Example 13 will be described. The arrow indicates the incident direction of the sound from the sound source.

The sound absorbing materials 821 and 822 were GW24k50t or jersey cloth. The sound absorbing material 821 was arranged between a group of thin round bars 815 and a group of thick round bars 816. The sound absorbing material 822 was arranged on the far side of the group of thick round bars 816 with respect to the sound source.

The reflector structure was formed of round bars 810 having a curved reflecting surface. Specifically, the group of thin round bars 815 and the group of thick round bars 816 shown in FIG. 29(*a*) were used. The round bars were arranged so as to increase in thickness with an increasing distance from the sound source.

Example 10 used neither of the sound absorbing materials 821 and 822. Example 11 included only a sound absorbing material 822 (GW24k50t). Example 12 included sound absorbing materials 821 (jersey cloth) and 822 (GW24k50t). Example 13 included sound absorbing materials 821 (GW24k50t) and 822 (GW24k50t).

Hereinafter, the measurement results of a change in the sound absorption coefficient will be described in more detail in order of Example 10, Example 11, Example 12, and Example 13.

Example 10

As refer to FIG. 29(*b*), description will be given of the measurement result of the sound absorption coefficient at each frequency when there was no sound absorbing material 821 or 822 but the reflector structure.

In such a case, the measurements of the sound absorption coefficient were in the range of 0.28 (at frequency of 125 Hz) to 0.13 (at frequency of 4000 Hz), roughly the same values across the low to high frequency ranges.

Example 11

As refer to FIG. 29(*b*), description will be given of the measurement result of the sound absorption coefficient at each frequency when there was the sound absorbing material 822 (GW24k50t) along with the reflector structure.

In such a case, the measurements of the sound absorption coefficient were in the range of 0.53 (at frequency of 125 Hz) to 0.20 (at frequency of 4000 Hz), roughly the same values across the low to high frequency ranges. As compared to Example 10, the sound absorption coefficient was higher across the entire frequency range.

Example 12

As refer to FIG. 29(*b*), description will be given of the measurement result of the sound absorption coefficient at each frequency when there were the sound absorbing material 821 (jersey cloth) and the sound absorbing material 822 (GW24k50t) along with the reflector structure.

In such a case, the measurements of the sound absorption coefficient were in the range of 0.53 (at frequency of 125 Hz) to 0.20 (at frequency of 4000 Hz), roughly the same values across the low to high frequency ranges. As compared to Examples 10 and 11, the sound absorption coefficient was higher across the entire frequency range.

Example 13

As refer to FIG. 29(*b*), description will be given of the measurement result of the sound absorption coefficient at each frequency when there were the sound absorbing material 821 (GW24k50t) and the sound absorbing material 822 (GW24k50t) along with the reflector structure.

In such a case, the measurements of the sound absorption coefficient were in the range of 0.67 (at frequency of 125 Hz) to 0.38 (at frequency of 4000 Hz), roughly the same values across the low to high frequency ranges. As compared to Example 10, Example 11, and Example 12, the sound absorption coefficient was higher across the entire frequency range.

In general, sound absorbing materials by themselves have higher absorption power in higher frequency ranges than in lower frequency ranges. As shown in Example 10, Example, 11, Example 12, and Example 13, the reflector structure of the present invention and the sound absorbing materials can be used to provide a sound absorption characteristic that has a uniform effect over the entire frequency range. In particular, the insertion of the sound absorbing materials in such locations as the center and rear spaces can adjust the sound absorption characteristic in low and high ranges to implement an arbitrary sound absorption characteristic of reducing the sound absorption coefficient across the entire frequency range. Such a sound absorption effect of the reflector structure of the present invention is unparalleled and is not easily conceivable by those skilled in the art. The reflector structure of the present invention and arbitrary sound absorbing materials can be combined to easily provide acoustic characteristics having various possible sound absorption coefficients corresponding to the respective frequency ranges.

In addition, the internal space of the reflectors can be utilized to provide sound absorbing power for certain frequencies by means of a Helmholtz absorption mechanism, micropore plate absorption mechanism, etc. This allows effective countermeasures against low-range standing waves in a room in particular.

[Comparison of Transmission Loss of Reflector Structure]

The reflector structure according to the embodiment of the present invention was measured for transmission loss in each frequency range, and examined for a change in the transmission loss. In the measurement, the amount of attenuation of sound when passing the reflector structure was measured and checked. Higher values of transmission loss indicate that it is harder for sound to pass through, and that the sound is reflected to the sound-source side. Lower values of transmission loss indicate that it is easier for sound to pass through to the sound-receiving side, and that the sound is only slightly reflected to the sound-source side.

Figure 30:
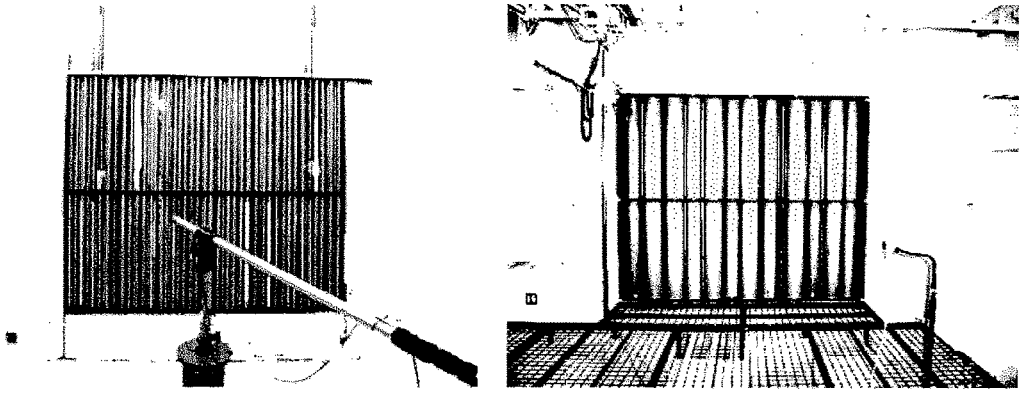
FIG. 30(*a*) is a diagram showing the concept of the measurement of the transmission loss of a reflector structure according to Example 14 of the embodiment of the present invention, and FIG. 30(*b*) is a chart showing the measurement results of the transmission loss of the reflector structure.
Figure 30:
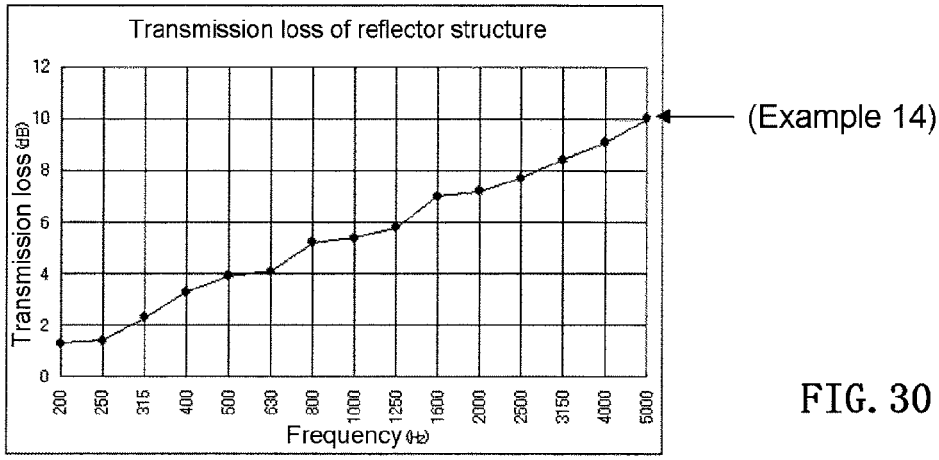

As refer to FIG. 30(*a*), the concept of the measurement of the transmission loss of the reflector structure in Example 14 will be described.

The reflector structure was formed of round bars 810 having a curved reflecting surface. FIG. 30(*a*) shows on the left the reflector structure as seen from the sound-source side, and on the right the reflector structure as seen from the sound-receiving side. As can be seen, the plurality of round bars 810 were arranged so as to increase in diameter in the passing direction of the sound from the sound source.

The measurement result of the transmission loss of the reflector structure will be described in more detail in the following Example 14.

Example 14

As refer to FIG. 30(*b*), description will be given of the measurement result of the transmission loss in each frequency range when there was the reflector structure.

In such a case, the transmission loss increased in value toward higher frequency ranges. For example, the transmission loss increased from approximately 3 dB (at frequency of 400 Hz) to approximately 6 dB (at frequency of 1250 Hz). It should be appreciated that a transmission loss of 3 dB makes the energy 1/2, and a transmission loss of 6 dB the energy 1/4. Given transmission loss=10 log(1/aperture ratio), an aperture ratio of 1/2 yields a transmission loss of 3 dB, and an aperture ratio of 1/4 a transmission loss of 6 dB by calculation.

If a diffusing material, reflecting material, or sound absorbing material is arranged in a position farther from such round bars of the largest diameter originated in the sound source, a diffusion, reflection, or sound absorption effect occurs in easily-transmissible low frequency ranges in particular. In addition, the diffusing material, reflecting material, or sound absorbing material may be made of any material in view of their respective characteristics.

The adjust the reflectance can be adjusted by installation density of the reflector structure. For example, the aperture ratio can be reduced to bounce back low-range sound and suppress room vibrations. The frequency characteristics can thus be changed to control the sound absorption and diffusion effect depending on the room. For example, it can be expected to produce a sound absorption and diffusion effect tailored to the design concept of the room.

According to the measurement result of the transmission loss of such a combination of columnar reflectors, the transmission loss tends to increase in value successively and smoothly from lower frequency ranges to wider frequency ranges. This also shows that impedance matching can be performed favorably.

The reflector structure of the present invention allows a free sound control across the entire frequency range simply by selecting the dimensions (size), the intervals (density), the sound absorption coefficient of the sound absorbing material, and the position of the sound absorbing material arbitrarily. The reflector structure is preferably arranged to form a lower occupation density and/or a smaller area of projection near the sound source, and form a higher occupation density and/or a larger area of projection far from the sound source.

The foregoing configuration provides the following effects.

The room sound field in various acoustic rooms such as a studio, listening booth, and hall sometimes becomes an issue of critical importance for recording engineers and players.

However, in the sound field of such various acoustic rooms, it is needed to adjust the balance between absorption and reflection. However, there is a problem that high ranges are tended to absorbed and low ranges are less to be absorbed.

If a limited room space is surrounded by sound absorbing walls so as to absorb even low-range sound and silence harmful reverberations, then the sense of reverberation decreases in high ranges in particular. This produces the sense of confinement, with the problem that the resulting acoustic space is unnatural and dull to listeners.

Thus, reflecting surfaces and sound absorbing surfaces may be moderately combined to adjust the reverberations, but it is difficult to resolve the artificiality.

The sound absorbing structure of conventional technology 1 can suppress long-path echoes and flutter echoes. However, due to the regular periodic arrangement, the technology prone to produce peculiar reflection properties in certain frequencies and cause differences in the energy attenuation of sound waves and the like depending on the positions within an acoustic room and the frequency ranges. There have thus been the problems of a narrow sweet spot and causing coloration.

Conventional sound traps such as oblique reflector plates used in conventional studios and the like also have had the problems of large differences of the sound field by location, a narrow sweet spot, and causing coloration because of the similar regular arrangement.

In contrast, according the sound field adjusting method of the embodiment of the present invention, the diameters of a plurality of columnar reflectors are calculated so as to diffuse sound waves of respective different frequency ranges, and an arrangement condition of the columnar reflectors having the calculated diameters is calculated so as to form a plurality of reflecting surfaces that reflect the sound waves of different frequency ranges in random reflection directions and/or with random reflection time delays or in random phases. This can prevent coloration and give an additional diffusion effect to the reflected sound for natural reverberations.

Consequently, in various acoustic rooms (room) that have columnar reflector structures according to the sound field adjusting method of the embodiment of the present invention, it is possible to provide a favorable sound field with less reflection periodicity over a wide range.

The uniform diffusion effect also yields the effect of providing a favorable sound field across the entire acoustic room, i.e., a wide sweet spot.

To obtain natural reverberations in the sound field of various acoustic rooms, a well-balanced sound absorption adjustment in each frequency range is essential in addition to the foregoing diffusion of the reflected sound.

According to conventional technology 1 and suchlike sound absorbing structures, however, it has been difficult to absorb low-range sound in various acoustic rooms of smaller volumes in particular. Increasing the sound absorbing materials only leads to the absorption of high-range sound, which has caused the sense of confinement.

The reason is, as described above, that adjusting the sound absorbing capacity by heavy use of sound absorbing materials results in excessive absorption of high-range sound while it is difficult to absorb low-range sound in a limited depth.

On the other hand, widening the reflecting surfaces to provide some reverberations, on the other hand, can produce harmful reflection with temporary concentration of reflected sound such as flutter echoes between wall surfaces, as well as unnatural reverberations.

It has thus been difficult to resolve artificiality by the periodic sound absorbing structure like conventional technology 1 in a space of small volume in particular.

In contrast, the use of the sound field adjusting method according to the embodiment of the present invention involves using columnar reflectors having a plurality of diameters corresponding to the frequency ranges to diffuse sound waves. The columnar reflectors are arranged in rows corresponding to high to low ranges, from the near side to far side with respect to the sound source. Such an arrangement can gradually change the acoustic resistances from sparse to dense, thereby diffusing a wide band of sound waves and resolving the inarticulateness due to insufficient absorption of low-range sound and the sense of confinement due to excessive absorption of high-range sound at the same time for the sake of favorable reflection properties.

Moreover, sound absorbing layers can be arranged in arbitrary positions in the group of columnar reflectors, and the frequency characteristics and the diffusion/absorption relationship can be controlled, which the effect to be enabled to use as an acoustic filter is obtained.

For example, a sound absorbing layer can be arranged between groups of columnar reflectors to adjust arbitrary reflection characteristics in low to high ranges.

Arranging a sound absorbing layer between a group of columnar reflectors and a wall provides the effect that it is possible to control reflected sound in a mid-low range.

With such effects, it is possible to provide a sound field adjusting method by using columnar reflectors, the method being capable of providing an acoustic improvement effect that is tailored to the characteristics of various acoustic rooms in which reflected sound needs to be well diffused with not much differences in the reflection properties depending on sound receiving points, and which need to be formed in a limited space, according to the acoustic purposes of the acoustic rooms.

The columnar reflector structure, or an acoustic diffuser that includes columnar reflectors according to the sound field adjusting method of the embodiment of the present invention, provides the effect of easy construction since the columns are installed in parallel with a wall surface. The vertical column-like installation reduces burdens on the building. Even under self-weight deformation or warpage, the columnar reflectors can be retained in their installation holes, which provides the effect of less aging degradation. Ball chain-like (spherical) and other configurations can also be constructed in a similar fashion.

Furthermore, the foregoing 3D scanner and a portable computer can be used to directly output the design drawing of the columnar reflector structure at the worksite and immediately execute the construction work. Since it is only needed to make holes having the diameters of the columnar reflectors into construction timber and insert the columnar reflectors, it is easy to manufacture a prearranged columnar reflector structure. Ball chain-like and entasis structures can be similarly formed by fitting and inserting the prefabricated columnar reflectors.

As described above, according to the sound field adjusting method of the embodiment of the present invention, it is possible to provide a sound field adjusting method for expanding the adjustable ranges of frequency characteristics and coverage by using diffuse sound generated by columnar reflectors that form a plurality of reflecting surfaces for reflecting sound waves of different frequency ranges in random reflection directions or with random reflection time delays (phases), so that diffuse sound having desired frequency characteristics corresponding to the purposes of various acoustic rooms is supplied to a wide area within the sound field.

It will be understood that the configuration and operations of the foregoing embodiment are just a few examples, and modifications may be made as appropriate without departing from the gist of the present invention.

What is claimed is:

1. A sound field adjusting method comprising:

calculating diameters of a plurality of columnar reflectors to diffuse sound waves of respective different frequency ranges;

calculating an arrangement condition for the columnar reflectors having the calculated diameters in order to have a plurality of reflecting surfaces, which make random reflection directions, reflection time delays, and/or phases of reflected sound for the sound waves of different frequency ranges; and outputting a graphical representation of the calculated diameters and calculated arrangement condition.

2. The sound field adjusting method according to claim 1, wherein the diameters and the arrangement condition are that the reflecting surfaces form a reflecting surface for a sound wave of a higher frequency range near a sound source, and form a reflecting surface for a sound wave of a lower frequency range far from the sound source.

3. The sound field adjusting method according to claim 1 or 2, wherein the diameters and the arrangement condition are that the columnar reflectors form a lower occupation density and/or a smaller area of projection near the/a sound source, and form a higher occupation density and/or a larger area of projection near the sound source.

4. The sound field adjusting method according to claim 1, wherein the diameters and the arrangement condition are that the columnar reflectors form a reflecting surface that matches an acoustic impedance of a medium between the/a sound source and the columnar reflectors to an acoustic impedance inside area of the columnar reflectors.

5. The sound field adjusting method according to claim 1, wherein the diameters and the arrangement condition are calculated that the columnar reflectors are arranged to diffuse reflected wavefronts of the sound waves.

6. The sound field adjusting method according to claim 1, wherein the diameters and the arrangement condition are that a diffusion wall, a reflecting wall, or a sound absorbing wall is arranged behind the columnar reflectors.

7. The sound field adjusting method according to claim 1, wherein the diameters and the arrangement condition are such that the columnar reflectors are arranged in two or more rows corresponding to the respective frequency ranges.

8. The sound field adjusting method according to claim 1, wherein further arranging sound absorbing layer in an area or around a group of columnar reflectors formed of the plurality of columnar reflectors, and energy of diffusion/absorption, a frequency range, a reflection direction, and a reflection time structure of a sound wave incident on the group of columnar reflectors controlling by a positional relationship between the sound absorbing layer and the group of columnar reflectors.

9. The sound field adjusting method according to claim 1, further comprising a sound absorbing structure that uses internal space of the columnar reflectors themselves.

10. The sound field adjusting method according to claim 1, wherein the columnar reflectors are generally circular columns, generally rectangular columns, generally elliptical columns, generally spherical in shape, or generally ball chain-like in shape.

11. The sound field adjusting method according to claim 1, wherein the columnar reflectors are made of wood, metal, resin, or plastic.

12. A columnar reflector structure arranged with the diameters and the arrangement condition calculated by the sound field adjusting method according to claim 1.

13. A reflector structure for diffusing, reflecting, or absorbing sound comprising:

a plurality of reflectors arranged, wherein the plurality of reflectors are arranged so that a reflector lying farther from a sound source has a) a diameter or thickness greater than that of a reflector lying closer to the sound source and/or b) has a higher occupation density and/or a larger area of projection than that of a reflector placed closer to the sound source; and the reflectors having a reflecting surface all or part being a curved surface.

14. The reflector structure according to claim 13, wherein the plurality of reflectors have different sizes.

15. The reflector structure according to claim 13, wherein the plurality of reflectors are arranged not to form parallel surfaces each other.

16. The reflector structure according to claim 13, wherein a sound absorbing material is arranged between and/or around the plurality of reflectors.

17. The reflector structure according to claim 13, wherein an acoustic diffusing surface, reflecting surface, or absorbing surface is arranged farther from the/a sound source than the plurality of reflectors.

18. A sound field adjusting method by using the reflector structure according to claim 13.

19. A room in which the columnar reflector structure according to claim 12 is arranged.

20. A non-transitory computer-readable medium having computer-executable instructions embodied thereon that, when executed, performs the sound field adjusting method according to claim 1.

21. An acoustic room designing system comprising a memory and processor that executes the instructions according to claim 20.

* * * * *